US011670215B2

(12) United States Patent
Kim et al.

(10) Patent No.: US 11,670,215 B2
(45) Date of Patent: Jun. 6, 2023

(54) DISPLAY DEVICE INCLUDING A DATA DRIVER PERFORMING CLOCK TRAINING, AND METHOD OF OPERATING THE DISPLAY DEVICE

(71) Applicant: Samsung Display Co., Ltd., Yongin-Si (KR)

(72) Inventors: Soo Yeon Kim, Namyangju-si (KR); Tae Gon Im, Gwangmyeong-si (KR); Hee-Jeong Seo, Hwaseong-si (KR)

(73) Assignee: Samsung Display Co., Ltd., Gyeonggi-Do Yongin-Si (KR)

( * ) Notice: Subject to any disclaimer, the term of this patent is extended or adjusted under 35 U.S.C. 154(b) by 100 days.

(21) Appl. No.: 17/011,967

(22) Filed: Sep. 3, 2020

(65) Prior Publication Data

US 2021/0280125 A1 Sep. 9, 2021

(30) Foreign Application Priority Data

Mar. 6, 2020 (KR) ..... 10-2020-0028617

(51) Int. Cl.
*G09G 3/20* (2006.01)

(52) U.S. Cl.
CPC ... *G09G 3/2092* (2013.01); *G09G 2310/0275* (2013.01); *G09G 2310/061* (2013.01)

(58) Field of Classification Search
CPC ..... G09G 3/2092; G09G 2310/0275; G09G 2310/061; G09G 5/006; G09G 2330/06; G09G 5/008; G09G 2340/0435; G09G 2370/08; G09G 3/2096; G09G 3/3275; G09G 2310/0243; G09G 2310/06; G09G 2310/08
See application file for complete search history.

(56) References Cited

U.S. PATENT DOCUMENTS

2013/0113777 A1* 5/2013 Baek ..... G09G 5/008 345/212
2014/0192097 A1* 7/2014 Baek ..... G09G 3/3688 345/87

(Continued)

FOREIGN PATENT DOCUMENTS

KR 10-1619693 B1 5/2016
KR 10-2016-0061537 A 6/2016
KR 10-2019-0124841 A 11/2019

*Primary Examiner* — Roberto W Flores
(74) *Attorney, Agent, or Firm* — Innovation Counsel LLP

(57) ABSTRACT

A display device includes a display panel including a plurality of pixels, a controller for providing a clock-embedded data signal including image data in an active period and including a training pattern in a blank period, and a data driver for recovering the image data from the clock-embedded data signal based on an internal clock signal to provide data voltages corresponding to the image data to the plurality of pixels in the active period, and to perform a training operation for the internal clock signal using the training pattern included in the clock-embedded data signal in the blank period. The training pattern in the blank period includes a first training clock signal modulated with a first modulation period during a first time, and includes a second training clock signal modulated with a second modulation period different from the first modulation period after the first time.

17 Claims, 14 Drawing Sheets

(56) References Cited

U.S. PATENT DOCUMENTS

| | | | | |
|---|---|---|---|---|
| 2015/0187315 | A1* | 7/2015 | Park | G09G 5/008 345/99 |
| 2016/0241251 | A1* | 8/2016 | Kim | H03L 7/0995 |
| 2016/0284300 | A1* | 9/2016 | Park | G09G 3/3648 |
| 2018/0144697 | A1* | 5/2018 | Kim | G09G 3/3607 |

* cited by examiner

DISPLAY DEVICE INCLUDING A DATA DRIVER PERFORMING CLOCK TRAINING, AND METHOD OF OPERATING THE DISPLAY DEVICE

CROSS-REFERENCE TO RELATED APPLICATION(S)

This application claims priority under 35 USC § 119 to Korean Patent Application No. 10-2020-0028617, filed on Mar. 6, 2020 in the Korean Intellectual Property Office (KIPO); the Korean Patent Application is incorporated by reference.

BACKGROUND

1. Field

The technical field relates to display devices and methods of operating the display devices.

2. Description of the Related Art

A display device may include pixels, a data driver providing data voltages to the pixels, a gate driver providing gate signals to the pixels, and a controller controlling the data driver and the gate driver.

The controller transfers image data to the data driver, which provides the pixels with the data voltages corresponding to the image data. In order to transfer the image data, a high speed interface, such as one of a unified standard interface for TV (a USI-T interface), a unified standard interface for notebook and monitor (a USI-GF interface), etc., may be used between the controller and the data driver.

In a display device using the USI-T interface or the USI-GF interface, the controller may transmit a clock-embedded data signal, and the data driver may recover a clock signal from the clock-embedded data signal using a clock data recovery (CDR) circuit, and may sample and restore a data signal using the recovered clock signal. To allow the recovered clock signal to have a desired frequency and/or a desired phase, the controller may transfer, as the clock-embedded data signal, a training pattern that periodically toggles, and the data driver may perform a clock training operation (or a locking operation) using the training pattern.

When a frame frequency is drastically changed, for example, when the frame frequency is changed to a half of the frame frequency, a lock sensing error of the data driver that determines the recovered clock signal in an unlock state to be in a lock state may occur, a clock signal corresponding to the changed frame frequency may not be recovered, and thus an operation error of the data driver may occur.

SUMMARY

Some embodiments may be related to a display device capable of preventing an operation error of a data driver even if a frame frequency is drastically changed.

Some embodiments may be related to a method of operating a display device capable of preventing an operation error of a data driver even if a frame frequency is drastically changed.

According to embodiments, a display device may include the following elements: a display panel including a plurality of pixels; a controller configured to provide a clock-embedded data signal, the clock-embedded data signal including image data in an active period and including a training pattern in a blank period; and a data driver configured to recover the image data from the clock-embedded data signal based on an internal clock signal in the active period, to provide data voltages corresponding to the image data to the plurality of pixels in the active period, and to perform a training operation for the internal clock signal by using the training pattern included in the clock-embedded data signal in the blank period. The training pattern in the blank period includes a first training clock signal modulated with a first modulation period during a first time, and includes a second training clock signal modulated with a second modulation period different from the first modulation period after the first time.

The display device may include a shared back channel electrically connected between the controller and the data driver. The data driver may include a clock data recovery circuit configured to recover the image data from the clock-embedded data signal in the active period, to perform the training operation that trains the internal clock signal based on the first training clock signal modulated with the first modulation period, and to inform the controller of a lock state of the internal clock signal through the shared back channel in response to the second training clock signal modulated with the second modulation period, and a data converting circuit configured to convert the image data into the data voltages in the active period, and to provide the data voltages to the plurality of pixels in the active period.

The clock data recovery circuit may include the following elements: a data recovery circuit configured to recover the image data from the clock-embedded data signal in response to the internal clock signal in the active period; a clock recovery circuit electrically connected to the data recovery circuit, configured to generate the internal clock signal, and configured to perform the training operation for the internal clock signal in response to a training enable signal; and a lock sensing circuit electrically connected to at least one of the data recovery circuit and the clock recovery circuit, configured to detect whether the internal clock signal is in the lock state or in an unlock state by determining whether the clock-embedded data signal has an edge in each clock period of the internal clock signal, and configured to provide the training enable signal to the clock recovery circuit when the internal clock signal is in the unlock state.

In embodiments, in response to the first training clock signal modulated with the first modulation period, the lock sensing circuit may provide the training enable signal to the clock recovery circuit, and may inform the controller of the unlock state of the internal clock signal through the shared back channel, and, in response to the second training clock signal modulated with the second modulation period, the lock sensing circuit may inform the controller of the lock state of the internal clock signal through the shared back channel.

The first time may be a clock phase locking time defined in a standard of an interface between the controller and the data driver.

The first modulation period may correspond to three times of a clock period of the internal clock signal, and the second modulation period may correspond to two times of the clock period of the internal clock signal.

The first modulation period may correspond to four times of a clock period of the internal clock signal, and the second modulation period may correspond to two times of the clock period of the internal clock signal.

The display device may include a shared back channel electrically connected between the data driver and the controller. The data driver may detect an unlock state of the internal clock signal, and may inform the controller of the unlock state of the internal clock signal through a shared back channel. In response to the unlock state of the internal clock signal received in the active period, the controller may stop transferring the clock-embedded data signal including the image data, and may transfer the clock-embedded data signal including the training pattern in the active period.

The training pattern in the active period may be substantially a same as the training pattern in the blank period.

The training pattern in the active period may be different from the training pattern in the blank period.

The training pattern in the active period may include only the second training clock signal modulated with the second modulation period.

The second modulation period may correspond to two times of a clock period of the internal clock signal.

The data driver may include a plurality of data driver integrated circuits, and the plurality of data driver integrated circuits may share the shared back channel.

According to embodiments, a display device may include the following elements: a display panel including a plurality of pixels; a controller configured to provide a clock-embedded data signal, the clock-embedded data signal including image data in an active period and including a training pattern in a blank period; and a data driver configured to receive the clock-embedded data signal, to recover the image data from the clock-embedded data signal based on an internal clock signal in the active period, to provide data voltages corresponding to the recovered image data to the plurality of pixels in the active period, and to perform a training operation for the internal clock signal by using the training pattern included in the clock-embedded data signal in the blank period. The controller detects whether a frame frequency is changed, and transfers the training pattern including a first training clock signal modulated with a first modulation period during a first time and including a second training clock signal modulated with a second modulation period different from the first modulation period after the first time in the blank period when or after the frame frequency is changed.

In embodiments, when the frame frequency is not changed, the controller may transfer the training pattern including only the second training clock signal modulated with the second modulation period in the blank period.

The first modulation period may correspond to three times of a clock period of the internal clock signal, and the second modulation period may correspond to two times of the clock period of the internal clock signal.

The first modulation period may correspond to four times of a clock period of the internal clock signal, and the second modulation period may correspond to two times of the clock period of the internal clock signal.

Embodiments may be related to a method of operating a display device. In the method, a controller of the display device transfers a clock-embedded data signal including image data to a data driver of the display device in an active period, the data driver recovers the image data from the clock-embedded data signal based on an internal clock signal to provide data voltages corresponding to the recovered image data to a plurality of pixels of a display panel of the display device in the active period, the controller transfers the clock-embedded data signal including a training pattern to the data driver in a blank period, and the data driver performs a training operation for the internal clock signal by using the training pattern included in the clock-embedded data signal in the blank period. The training pattern in the blank period includes a first training clock signal modulated with a first modulation period during a first time, and includes a second training clock signal modulated with a second modulation period different from the first modulation period after the first time.

The data driver may detect an unlock state of the internal clock signal, and the data driver may inform the controller of the unlock state of the internal clock signal through a shared back channel.

The controller may stop transferring the clock-embedded data signal including the image data in response to the unlock state of the internal clock signal received in the active period, and the controller may transfer the clock-embedded data signal including the training pattern to the data driver in the active period.

According to embodiments, a training pattern transferred from a controller to a data driver in a blank period may include a first training clock signal modulated with a first modulation period during a first time, and a second training clock signal modulated with a second modulation period different from the first modulation period after the first time. Accordingly, even if a frame frequency of the display device is changed, a lock sensing error of the data driver may be prevented, and an operation error of the data driver may be prevented.

DETAILED DESCRIPTION OF EMBODIMENTS

Example embodiments are described with reference to the accompanying drawings. Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

The expression "during the first/second time" may mean "(substantially) throughout the first/second time" and/or "for the period of the first/second time."

Figure 1:
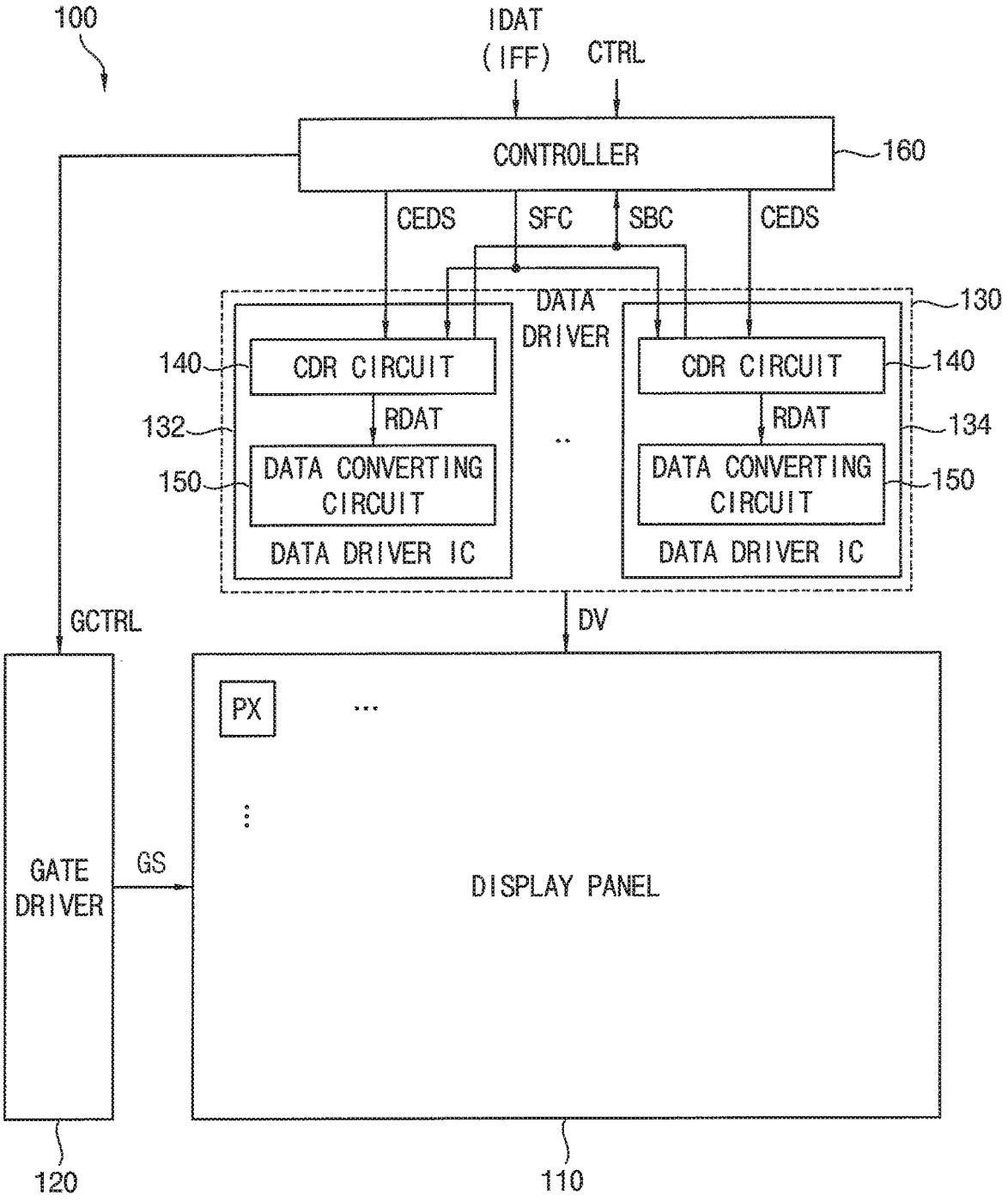
FIG. 1 is a block diagram illustrating a display device according to embodiments.
Figure 2:
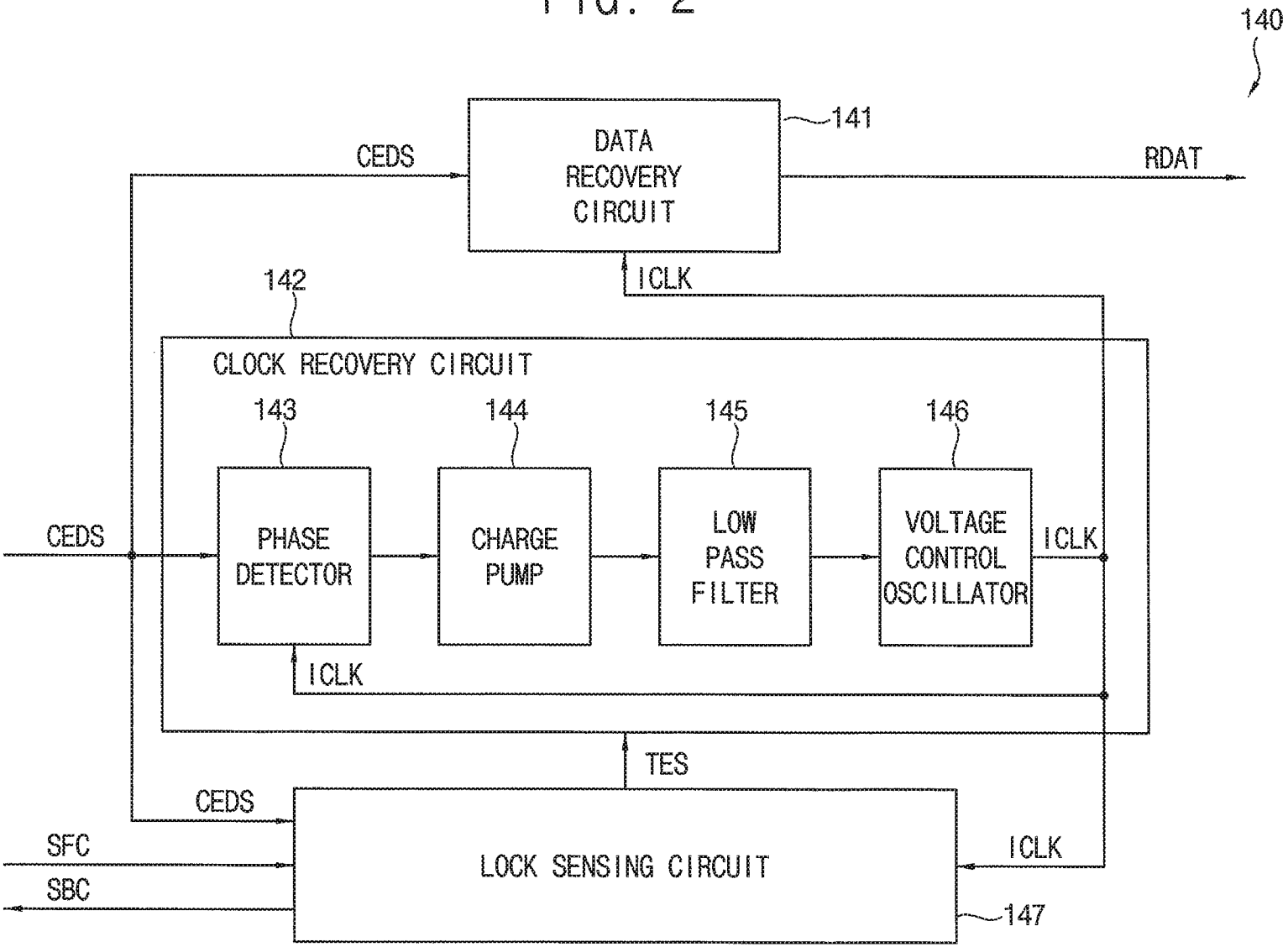
FIG. 2 is a block diagram illustrating a clock data recovery circuit included in a display device according to embodiments.
Figure 3:
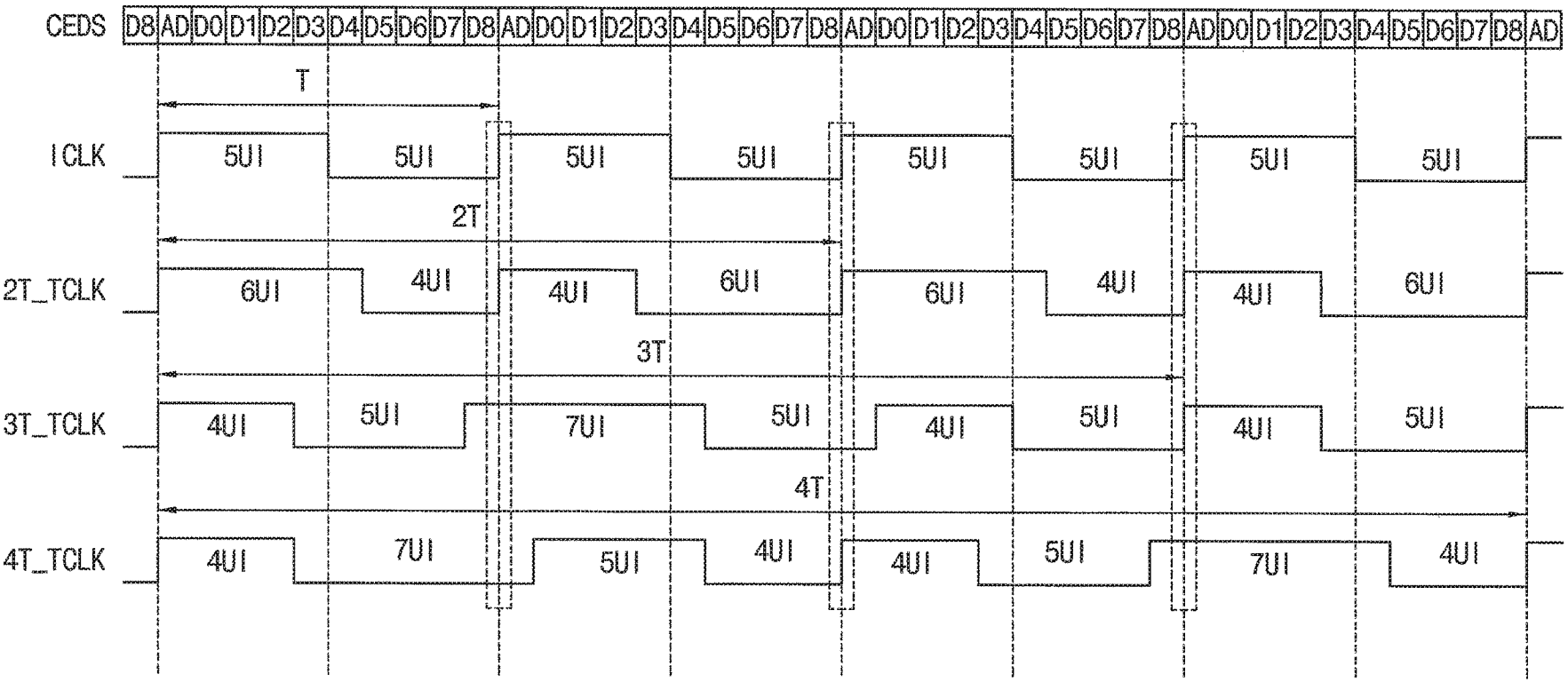
FIG. 3 is a diagram illustrating a clock-embedded data signal, an internal clock signal, a training clock signal modulated with a modulation period corresponding to two clock periods, a training clock signal modulated with a modulation period corresponding to three clock periods, and a training clock signal modulated with a modulation period corresponding to four clock periods according to embodiments.

FIG. 1 is a block diagram illustrating a display device according to embodiments. FIG. 2 is a block diagram illustrating a clock data recovery circuit included in a display device according to embodiments. FIG. 3 is a diagram illustrating a clock-embedded data signal, an internal clock signal, a training clock signal modulated with a modulation period corresponding to two clock periods, a training clock signal modulated with a modulation period corresponding to three clock periods, and a training clock signal modulated with a modulation period corresponding to four clock periods.

Referring to FIG. 1, a display device 100 may include a display panel 110 including a plurality of pixels PX, a gate driver 120 that provides gate signals GS to the plurality of pixels PX, a data driver 130 that provides data voltages DV to the plurality of pixels PX, and a controller 160 that controls the gate driver 120 and the data driver 130.

The display panel 110 may include a plurality of data lines, a plurality of gate lines, and the plurality of pixels PX coupled to the plurality of data lines and the plurality of gate lines. Each pixel PX may include a switching transistor, and a liquid crystal capacitor coupled to the switching transistor, and the display panel 110 may be a liquid crystal display (LCD) panel. Each pixel PX may include at least two transistors, at least one capacitor, and an organic light emitting diode (OLED); the display panel 110 may be an OLED display panel. Each pixel PX may include an inorganic light emitting diode or a quantum dot light emitting diode, and the display panel 110 may be an inorganic light emitting diode display panel or a quantum dot light emitting diode display panel.

The gate driver 120 may generate the gate signals GS based on a gate control signal GCTRL received from the controller 160, and may provide the gate signals GS to the plurality of pixels PX through the plurality of gate lines. The gate control signal GCTRL may include a gate start signal and a gate clock signal. The gate driver 120 may be an amorphous silicon gate (ASG) driver integrated in a peripheral portion of the display panel 110. The gate driver 120 may be implemented with one or more gate integrated circuits (ICs). The gate driver 120 may be mounted directly on the display panel 110, or may be coupled to the display panel 110 in a form of a chip on film (COF).

The data driver 130 may receive a clock-embedded data signal CEDS including image data IDAT from the controller 160, may generate the data voltages DV based on the clock-embedded data signal CEDS, and may provide the data voltages DV to the plurality of pixels PX through the plurality of data lines. As illustrated in FIG. 1, the data driver 130 may be implemented with a plurality of data driver ICs 132, . . . , 134. The plurality of data driver ICs 132, . . . , 134 may receive corresponding clock-embedded data signals CEDS from the controller 160 through clock-embedded data lines, respectively. The plurality of data driver ICs 132, . . . , 134 may be mounted directly on the display panel 110, or may be coupled to the display panel 110 in the form of the COF. The data driver 130 may be implemented with a single data driver IC, or may be integrated in the peripheral portion of the display panel 110.

The controller 160, e.g., a timing controller (TCON), may receive the image data IDAT and a control signal CTRL from an external host processor, e.g., a graphic processing unit (GPU) or a graphic card. The image data IDAT may be RGB image data including red image data, green image data, and blue image data. The control signal CTRL may include a vertical synchronization signal, a horizontal synchronization signal, an input data enable signal, a master clock signal, and/or the like. The controller 160 may generate the clock-embedded data signal CEDS and the gate control signal GCCTL based on the image data IDAT and the control signal CTRL. The controller 160 may control an operation of the gate driver 120 by providing the gate control signal GCTRL to the gate driver 120, and may control an operation of the data driver 130 by providing the clock-embedded data signal CEDS to the data driver 130.

In the display device 100, a high speed interface for transferring the image data IDAT, such as at least one of a unified standard interface for TV (a USI-T interface), a unified standard interface for notebook and monitor (a USI-GF interface), etc., may be used between the controller 160 and the data driver 130, and the image data IDAT may be transferred from the controller 160 to the data driver 130 in the form of the clock-embedded data signal CEDS defined in a standard of the high speed interface. For example, as illustrated in FIG. 3, the clock-embedded data signal CEDS may have a format including a plurality of data bits D0, D1, D2, D3, D4, D5, D6, D7, and D8 and an additional bit AD appended to the plurality of data bits DO through D8. The additional bit AD may have a level opposite to a level of the last data bit D8, and thus the clock-embedded data signal CEDS may have a periodic edge between the last data bit D8 and the additional bit AD. The data driver 130 may generate an internal clock signal of the data driver 130 based on the periodic edge of the clock-embedded data signal CEDS.

In the display device 100, the controller 160 may transfer the clock-embedded data signal CEDS including the image data IDAT to the data driver 130 in an active period of a frame period of the display device 100, and may transfer the clock-embedded data signal CEDS including a training pattern to the data driver 130 in a blank period of the frame period. The data driver 130 may recover the image data IDAT from the clock-embedded data signal CEDS based on the internal clock signal in the active period, and may provide the data voltages DV corresponding to the recovered image data RDAT to the plurality of pixels PX in the active period. In the blank period, the data driver 130 may perform a training operation for the internal clock signal using the training pattern included in the clock-embedded data signal CEDS. The training operation (or a locking operation) for the internal clock signal may be an operation that adjusts a frequency and/or a phase of the internal clock signal to allow the internal clock signal to have a desired frequency and/or a desired phase corresponding to the training pattern.

The display device 100 may further include, between the controller 160 and the data driver 130, a shared forward channel SFC for the controller 160 to inform the data driver 130 of transferring the training pattern as the clock-embedded data signal CEDS, and a shared back channel SBC for data driver 130 to inform the controller 160 of a lock state or an unlock state of the internal clock signal. The controller 160 may inform the data driver 130 of transferring the training pattern by changing the shared forward channel SFC to a low level. The data driver 130 may inform the controller 160 of the unlock state of the internal clock signal by changing the shared back channel SBC to a low level, and may inform the controller 160 of the lock state of the internal clock signal by changing the shared back channel SBC to a high level. As illustrated in FIG. 1, the data driver 130 may be implemented with the plurality of data driver ICs 132, . . . , 134, and the plurality of data driver ICs 132, . . . , 134 may share the shared forward channel SFC and the shared back channel SBC. Thus, the controller 160 may inform the plurality of data driver ICs 132, . . . , 134 of transferring the training pattern using the single shared forward channel SFC, and the plurality of data driver ICs 132, . . . , 134 may inform the controller 160 of the lock states or the unlock states of their internal clock signals using the single shared back channel SBC. If any one of the plurality of internal clock signals of the plurality of data driver ICs 132, . . . , 134 is in the unlock state, the single shared back channel SBC may be changed to the low level.

To provide the data voltages DV to the plurality of pixels PX in the active period and to perform the training operation for the internal clock signal in the blank period, the data driver 130 may include a clock data recovery (CDR) circuit 140 and a data converting circuit 150. The clock data recovery circuit 140 may generate the recovered image data RDAT using the clock-embedded data signal CEDS in the active period, and may perform the training operation for the internal clock signal using the training pattern in the blank period. The data converting circuit 150 may convert the recovered image data RDAT into data voltages DV in the active period, and may provide the data voltages DV to pixels PX in the active period. When the data driver 130 includes the plurality of data driver ICs 132, . . . , 134, each data driver IC 132, . . . , 134 may include a clock data recovery circuit 140 and a data converting circuit 150.

As illustrated in FIG. 2, a clock data recovery circuit 140 may include a data recovery circuit 141, a clock recovery circuit 142, and a lock sensing circuit 147. The data recovery circuit 141 may receive the internal clock signal ICLK from the clock recovery circuit 142, and may generate the recovered image data RDAT from the clock-embedded data signal CEDS (for example, by sampling the image data IDAT included in the clock-embedded data signal CEDS) in response to the internal clock signal ICLK in the active period. The data recovery circuit 141 may receive a multi-phase internal clock signal ICLK having multiple phases (Ten phases) from the clock recovery circuit 142, and may generate the recovered image data RDAT by sampling the clock-embedded data signal CEDS at each 1 unit interval (UI) based on the multi-phase internal clock signal ICLK.

The clock recovery circuit 142 may generate the internal clock signal ICLK, and may perform the training operation for the internal clock signal ICLK in response to a training enable signal TES. The clock recovery circuit 142 may include a phase detector 143, a charge pump 144, a low pass filter 145, and a voltage control oscillator 146. The phase detector 143 may generate a signal (e.g., an up signal and/or a down signal) corresponding to a phase difference between the internal clock signal ICLK and the clock-embedded data signal CEDS. In response to the signal of the phase detector 143, the charge pump 144 may provide a current to the low pass filter 145, or may draw a current from the low pass filter 145. In response to a positive current or a negative current from the charge pump 144, the low pass filter 145 may increase or decrease a control voltage. The charge pump 144 may remove or reduce a high frequency noise component of the internal clock signal ICLK. The voltage control oscillator 146 may adjust a frequency and/or a phase of the internal clock signal ICLK in response to the control voltage from the low pass filter 145. The clock recovery circuit 142 may be implemented as a phase locked loop (PLL) circuit as illustrated in FIG. 2. The clock recovery circuit 142 may be implemented as a delay locked loop (DLL) circuit. The clock recovery circuit 142 implemented as the DLL circuit may include a phase comparator, a digital loop filter, and a delay line.

The lock sensing circuit 147 may detect whether the internal clock signal ICLK is in the lock state or in the unlock state (or a lock fail) by determining whether the clock-embedded data signal CEDS has an edge in each clock period of the internal clock signal ICLK (for example, not only in the blank period, but also in the active period). For example, as illustrated in FIG. 3, the lock sensing circuit 147 may determine whether the clock-embedded data signal CEDS has the edge between the last data bit D8 of the plurality of data bits D0 through D8 and the additional bit AD at each (and every) clock period T of the internal clock signal ICLK. The lock sensing circuit 147 may determine whether the clock-embedded data signal CEDS has the edge within a period having a certain time margin with respect to a time point between the last data bit D8 and the additional bit AD. The lock sensing circuit 147 may determine that the internal clock signal ICLK is in the lock state in a case where the clock-embedded data signal CEDS has the edge within a period from about 1 UI before the time point between the last data bit D8 and the additional bit AD to about 1 UI after the time point between the last data bit D8 and the additional bit AD. When/if the clock-embedded data signal CEDS does not have the edge within the period, the lock sensing circuit 147 may determine that the internal clock signal ICLK is in the unlock state (or the lock fail), and may provide the training enable signal TES to the clock recovery circuit 142. The clock recovery circuit 142 may perform the training operation for the internal clock signal ICLK in response to the training enable signal TES from the lock sensing circuit 147. The lock sensing circuit 147 may be informed that the training pattern is transferred as the clock-embedded data signal CEDS through the shared forward channel SFC, and may inform the controller 160 of the lock state or the unlock state of the internal clock signal ICLK through the shared back channel SBC.

The data converting circuit 150 may include a shift register array that sequentially stores the recovered image data RDAT, a data latch array that loads the recovered image data RDAT stored in the shift register array in response to a load signal, a digital-to-analog converter array that converts the recovered image data RDAT output from the data latch array into the data voltages DV using gamma voltages, and an output buffer array that outputs the data voltages DV to the plurality of data lines.

As illustrated in FIG. 3, in the display device 100, a training clock signal 2T_TCLK modulated with a modulation period corresponding to two clock periods 2T of the internal clock signal ICLK, a training clock signal 3T_TCLK modulated with a modulation period corresponding to three clock periods 3T of the internal clock signal ICLK, and/or a training clock signal 4T_TCLK modulated with a modulation period corresponding to four clock periods 4T of the internal clock signal ICLK may be used as the training pattern. The training clock signal 2T_TCLK modulated with the modulation period corresponding to the two clock periods 2T may periodically have a high period of about 6 UI, a low period of about 4 UI, a high period of about 4 UI and a low period of about 6 UI. The training clock signal 3T_TCLK modulated with the modulation period corresponding to the three clock periods 3T may periodically have a high period of about 4 UI, a low period of about 5 UI, a high period of about 7 UI, a low period of about 5 UI, a high period of about 4 UI, and a low period of about 5 UI. The training clock signal 4T_TCLK modulated with the modulation period corresponding to the four clock periods 4T may periodically have a high period of about 4 UI, a low period of about 7 UI, a high period of about 5 UI, a low period of about 4 UI, a high period of about 4 UI, a low period of about 5 UI, a high period of about 7 UI, and a low period of about 4 UI. UI may correspond to a time allocated to transfer one bit of the clock-embedded data signal CEDS.

Referring to FIG. 3, even if a frame frequency of the display device 100 is not changed, and the internal clock signal ICLK is in the lock state in synchronization with the clock-embedded data signal CEDS, when/if the lock sensing circuit 147 receives, as the training pattern, the training clock signal 3T_TCLK modulated with the modulation period corresponding to the three clock periods 3T or the training clock signal 4T_TCLK modulated with the modulation period corresponding to the four clock periods 4T, the lock sensing circuit 147 may determine that the training clock signal 3T_TCLK modulated with the modulation period corresponding to the three clock periods 3T or the training clock signal 4T_TCLK modulated with the modulation period corresponding to the four clock periods 4T does not have an edge between the last data bit D8 and the additional bit AD, and thus may erroneously determine that the internal clock signal ICLK is in the unlock state. That is, even if the frame frequency is not changed, and the internal clock signal ICLK is in the lock state, in the case where the controller 160 transfers, as the training pattern, the training clock signal 3T_TCLK or 4T_TCLK modulated with the modulation period corresponding to the three clock periods 3T or the four clock periods 4T, the data driver 130 may continuously maintain the shared back channel SBC as the low level for informing the unlock state by erroneously determining that the internal clock signal ICLK is in the unlock state, and the controller 160 may continuously transfer the training pattern as the clock-embedded data signal CEDS in response to the shared back channel SBC continuously maintained as the low level. To prevent the lock sensing circuit 147 from erroneously determining that the internal clock signal ICLK is in the unlock state even if the frame frequency is not changed and the internal clock signal ICLK is in the lock state in synchronization with the clock-embedded data signal CEDS, only the training clock signal 2T_TCLK modulated with the modulation period corresponding to the two clock periods 2T of the internal clock signal ICLK may be used as the training pattern.

Figure 4:
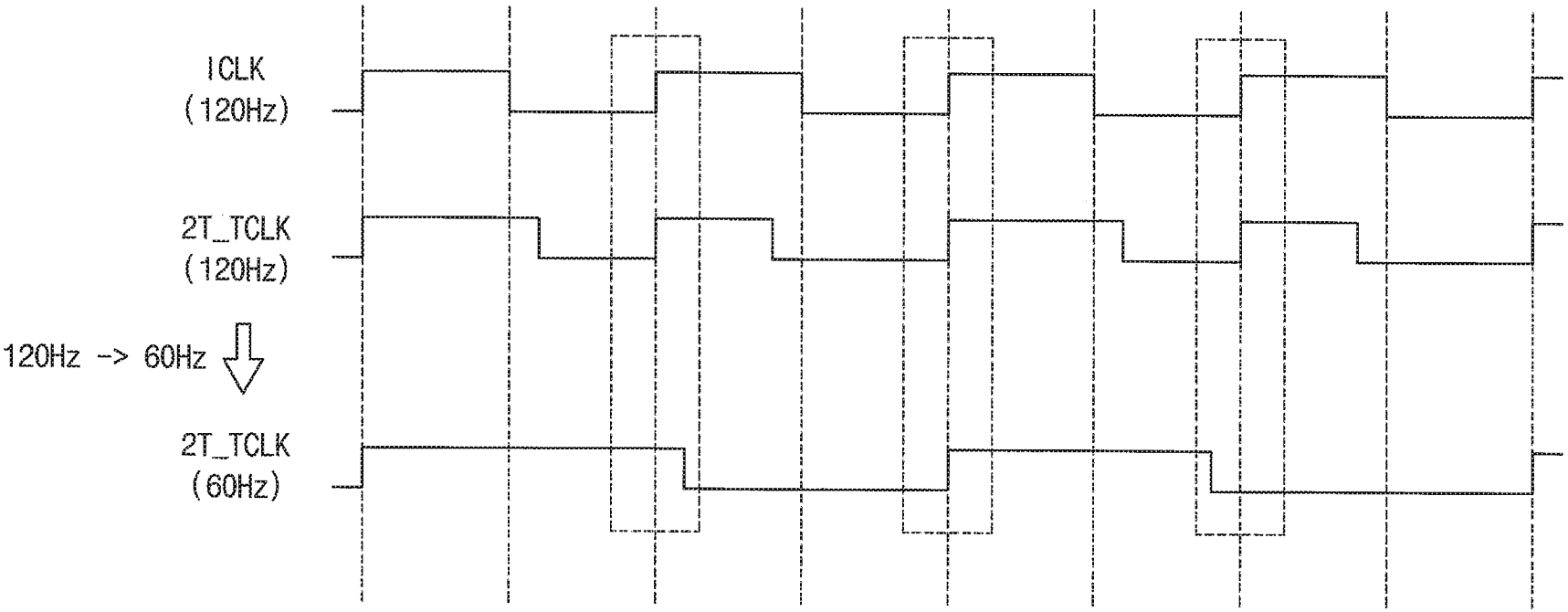
FIG. 4 (PRIOR ART)
FIG. 4 is a diagram for describing an example of a lock sensing error in a case where a frame frequency is changed according to embodiments.

Referring to FIG. 4, although the training clock signal 2T_TCLK modulated with the modulation period corresponding to the two clock periods 2T is used as the training pattern, when/if the frame frequency of the display device 100 is drastically changed, for example when/if the frame frequency of the display device 100 is changed from about 120 Hz to about 60 Hz, a frequency of the training clock signal 2T_TCLK may be decreased to a half of the frequency, a clock period of the training clock signal 2T_TCLK may be increased to a double of the clock period, but the lock sensing circuit 147 may erroneously determine that the internal clock signal ICLK corresponding to the frame frequency of about 120 Hz before change is still in the lock state after the change of the frame frequency. Accordingly, even if the frame frequency of the display device 100 is changed from about 120 Hz to about 60 Hz, in the case where the training clock signal 2T_TCLK modulated with the modulation period corresponding to the two clock periods 2T is used as the training pattern, the data driver 130 may not perform the training operation for the internal clock signal ICLK. That is, when the frame frequency is drastically changed, a lock sensing error (where the lock sensing circuit 147 erroneously determines the internal clock signal ICLK in the unlock state to be in the lock state) may occur, and thus an operation error of the data driver 130 may occur. When/if the frame frequency of the display device 100 is changed from about 60 Hz to about 120 Hz, and the training clock signal 2T_TCLK modulated with the modulation period corresponding to the two clock periods 2T is used as the training pattern, the lock sensing error where the lock sensing circuit 147 erroneously determines that the internal clock signal ICLK corresponding to the frame frequency of about 60 Hz before change is still in the lock state after the change of the frame frequency may occur. Referring to FIG. 3, when/if the training clock signal 3T_TCLK modulated with the modulation period corresponding to the three clock periods 3T or the training clock signal 4T_TCLK modulated with the modulation period corresponding to the four clock periods 4T is used as the training pattern, the lock sensing circuit 147 may determine that the internal clock signal ICLK is in the unlock state regardless of whether the frame frequency is changed or not. Thus, if the training clock signal 3T_TCLK or 4T_TCLK modulated with the modulation period corresponding to the three clock periods 3T or the four clock periods 4T is used as the training pattern, not only in the case where the frame frequency is not changed, but also in the case where the frame frequency is changed, the lock sensing circuit 147 may determine that the internal clock signal ICLK is in the unlock state, and the clock data recovery circuit 140 may train the internal clock signal ICLK corresponding to the changed frame frequency based on the training clock signal 3T_TCLK or 4T_TCLK corresponding to the changed frame frequency. Accordingly, in the display device 100, by utilizing the feature that the lock sensing circuit 147 determines the internal clock signal ICLK to be in the unlock state not only in the case where the frame frequency is not changed but also in the case where the frame frequency is changed if the training clock signal 3T_TCLK or 4T_TCLK modulated with the modulation period corresponding to the three clock periods 3T or the four clock periods 4T is used as the training pattern, a combination of the training clock signal 3T_TCLK or 4T_TCLK modulated with the modulation period corresponding to the three clock periods 3T or the four clock periods 4T and the training clock signal 2T_TCLK modulated with the modulation period corresponding to the two clock periods 2T may be used as the training pattern.

Thus, in the display device 100, the training pattern transferred as the clock-embedded data signal CEDS from the controller 160 to the data driver 130 in the blank period may include a first training clock signal modulated with a first modulation period during a first time, and may include a second training clock signal modulated with a second modulation period different from the first modulation period after the first time. The first time may be a (minimum) clock phase locking time, for example about 4,500 clock periods (4500 T), defined in a standard of an interface, for example the USI-T interface or the USI-GF interface, between the controller 160 and the data driver 130.

The first modulation period of the first training clock signal may correspond to 3T (i.e., three times of the clock period T of the internal clock signal ICLK), and the second modulation period of second training clock signal may correspond to 2 T (i.e., two times of the clock period T of the internal clock signal ICLK). Thus, as the training pattern in the blank period, the controller 160 may transfer the training clock signal 3T_TCLK modulated with the modulation period corresponding to the three clock periods 3T during the first time, and may transfer the training clock signal 2T_TCLK modulated with the modulation period corresponding to the two clock periods 2T after the first time. In response to the training clock signal 3T_TCLK modulated with the modulation period corresponding to the three clock periods 3T, the lock sensing circuit 147 may determine that the internal clock signal ICLK is in the unlock state, may provide the training enable signal TES to the clock recovery circuit 142, and may inform the controller 160 of the unlock state of the internal clock signal ICLK through the shared back channel SBC. When the training clock signal 3T_TCLK modulated with the modulation period corresponding to the three clock periods 3T is transferred, the clock recovery circuit 142 may perform the training operation for the internal clock signal ICLK in response to the training enable signal TES. Since the training clock signal 3T_TCLK modulated with the modulation period corresponding to the three clock periods 3T is transferred during the first time (for example, during the clock phase locking time defined in the USI-T interface standard or the USI-GF interface standard), and the training operation for the internal clock signal ICLK is performed during the first time, the lock sensing circuit 147 may determine that the internal clock signal ICLK is in the unlock state during the first time, but the internal clock signal ICLK generated by the clock recovery circuit 142 may be actually in the lock state at a time point after the first time. If the training clock signal 2T_TCLK modulated with the modulation period corresponding to the two clock periods 2T is transferred after the first time, in response to the training clock signal 2T_TCLK modulated with the modulation period corresponding to the two clock periods 2T, the lock sensing circuit 147 may determine that internal clock signal ICLK is in the lock state, and may inform the controller 160 of the lock state of the internal clock signal ICLK through the shared back channel SBC. The controller 160 may stop transferring the training pattern in response to the lock state of the internal clock signal ICLK received through the shared back channel SBC.

The first modulation period of the first training clock signal may correspond to 4T (i.e., four times of the clock period T of the internal clock signal ICLK), and the second modulation period of second training clock signal may correspond to 2T (i.e., two times of the clock period T of the internal clock signal ICLK). Thus, as the training pattern in the blank period, the controller 160 may transfer the training clock signal 4T_TCLK modulated with the modulation period corresponding to the four clock periods 4T during the first time, and may transfer the training clock signal 2T_TCLK modulated with the modulation period corresponding to the two clock periods 2T after the first time. The clock data recovery circuit 140 may perform the training operation for the internal clock signal ICLK based on the training clock signal 4T_TCLK modulated with the modulation period corresponding to the four clock periods 4T during the first time, and may inform the controller 160 of the lock state of the internal clock signal ICLK through the shared back channel SBC in response to the training clock signal 2T_TCLK modulated with the modulation period corresponding to the two clock periods 2T after the first time.

Even if the frame frequency of the display device 100 is drastically changed (for example, from about 120 Hz to about 60 Hz, or from about 60 Hz to about 120 Hz), because the training clock signal 3T_TCLK modulated with the modulation period corresponding to the three clock periods 3T or the training clock signal 4T_TCLK modulated with the modulation period corresponding to the four clock periods 4T is transferred during the first time, the lock sensing circuit 147 may determine that the internal clock signal ICLK is in the unlock state in response to the training clock signal 3T_TCLK modulated with the modulation period corresponding to the three clock periods 3T or the training clock signal 4T_TCLK modulated with the modulation period corresponding to the four clock periods 4T, and thus a potential lock sensing error (where the training clock signal 2T_TCLK in the unlock state is erroneously determined to be in the lock state) may be prevented. Thus, when the frame frequency of the display device 100 is drastically changed from about 120 Hz to about 60 Hz, the lock sensing circuit 147 may determine that the internal clock signal ICLK is in the unlock state, the clock data recovery circuit 140 may train the internal clock signal ICLK corresponding to the changed frame frequency of about 60 Hz based on the training clock signal 3T_TCLK or 4T_TCLK corresponding to the changed frame frequency of about 60 Hz during the first time. That is, in the display device 100, even if the frame frequency of the display device 100 is drastically changed, the internal clock signal ICLK may be trained corresponding to the changed frame frequency, and thus a problem potentially caused by erroneously determining that the internal clock signal ICLK is in the lock state (given that only the training clock signal 2T_TCLK modulated with the modulation period corresponding to the two clock periods 2T is used as the training pattern) may be prevented. Further, since the training clock signal 2T_TCLK modulated with the modulation period corresponding to the two clock periods 2T is transferred after the first time, a potential problem where the shared back channel SBC cannot be changed to the high level for informing the lock state (given that only the training clock signal 3T_TCLK or 4T_TCLK modulated with the modulation period corresponding to the three clock periods 3T or the four clock periods 4T is used as the training pattern) may be prevented.

The lock sensing circuit 147 may detect the unlock state of the internal clock signal ICLK in each clock period of the internal clock signal ICLK not only in the blank period, but also in the active period, and may inform the controller 160 of the unlock state of the internal clock signal ICLK through the shared back channel SBC. When/if an electrostatic discharge occurs in the data driver 130, the internal clock signal ICLK may become in the unlock state, and the lock sensing circuit 147 may inform the controller 160 of the unlock state of the internal clock signal ICLK by changing the shared back channel SBC to the low level. Once the controller 160 is informed of the unlock state of the internal clock signal ICLK through the shared back channel SBC, the controller 160 may stop transferring the clock-embedded data signal CEDS including the image data IDAT, and may transfer the clock-embedded data signal CEDS including the training pattern in the active period. If transferring the training pattern is completed in the active period, the controller 160 may resume transferring the clock-embedded data signal CEDS including the image data IDAT.

The training pattern in the active period may be substantially the same as the training pattern in the blank period. For example, as the training pattern in the active period, the controller 160 may transfer the training clock signal 3T_TCLK modulated with the modulation period corresponding to the three clock periods 3T during the first time, and may transfer the training clock signal 2T_TCLK modulated with the modulation period corresponding to the two clock periods 2T after the first time. In another example, as the training pattern in the active period, the controller 160 may transfer the training clock signal 4T_TCLK modulated with the modulation period corresponding to the four clock periods 4T during the first time, and may transfer the training clock signal 2T_TCLK modulated with the modulation period corresponding to the two clock periods 2T after the first time.

The training pattern in the active period may be different from the training pattern in the blank period. The training pattern in the active period may include only the second training clock signal modulated with the second modulation period. Thus, as the training pattern in the active period, the controller 160 may transfer only the training clock signal 2T_TCLK modulated with the modulation period corresponding to the two clock periods 2T. In an example, the controller 160 may transfer the training clock signal 2T_TCLK modulated with the modulation period corresponding to the two clock periods 2T during about 2,000 clock periods (2000 T).

In the display device 100, the controller 160 may detect whether the frame frequency of the display device 100 is changed. The controller 160 may detect the change of the frame frequency by detecting a change of an input frame frequency IFF of the image data IDAT. When the frame frequency is not changed, the controller 160 may transfer the training pattern including only the second training clock signal modulated with the second modulation period (e.g., the training clock signal 2T_TCLK modulated with the modulation period corresponding to the two clock periods 2T). When the frame frequency is changed, as the training pattern, the controller 160 may transfer the first training clock signal modulated with the first modulation period (e.g., the training clock signal 3T_TCLK modulated with the modulation period corresponding to the three clock periods 3T or the training clock signal 4T_TCLK modulated with the modulation period corresponding to the four clock periods 4T) during the first time, and may transfer the second training clock signal modulated with the second modulation period (e.g., the training clock signal 2T_TCLK modulated with the modulation period corresponding to the two clock periods 2T) after the first time.

In the display device 100, as the training pattern, the controller 160 may transfer the first training clock signal modulated with the first modulation period (e.g., the training clock signal 3T_TCLK or the training clock signal 4T_TCLK) during the first time, and may transfer the second training clock signal modulated with the second modulation period different from the first modulation period (e.g., the training clock signal 2T_TCLK) after the first time. Accordingly, even if the frame frequency of the display device 100 is changed, the lock sensing error of the data driver 130 may be prevented, and the operation error of the data driver 130 may be prevented.

Figure 5:
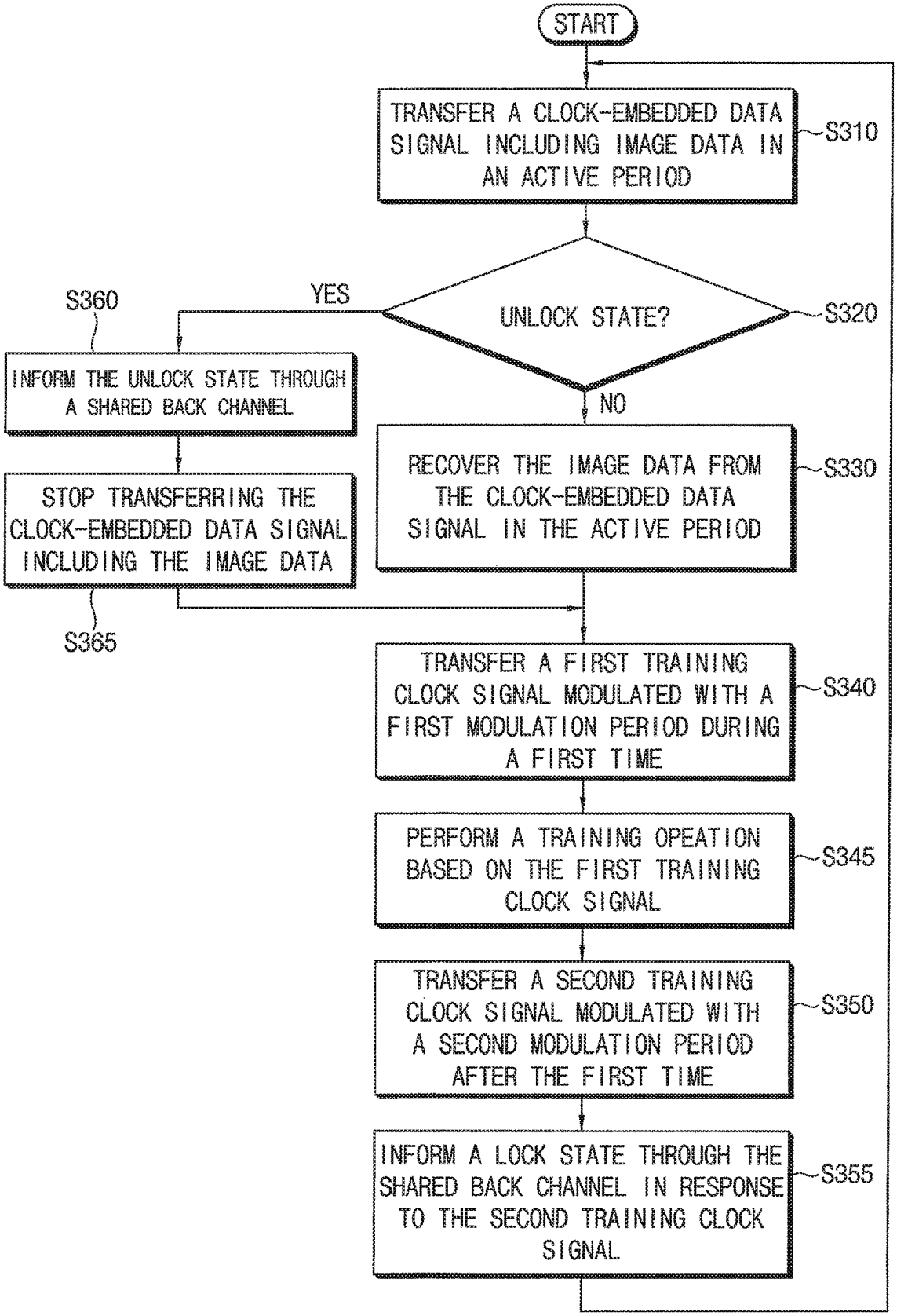
FIG. 5 is a flow chart illustrating a method of operating a display device according to embodiments.
Figure 6:
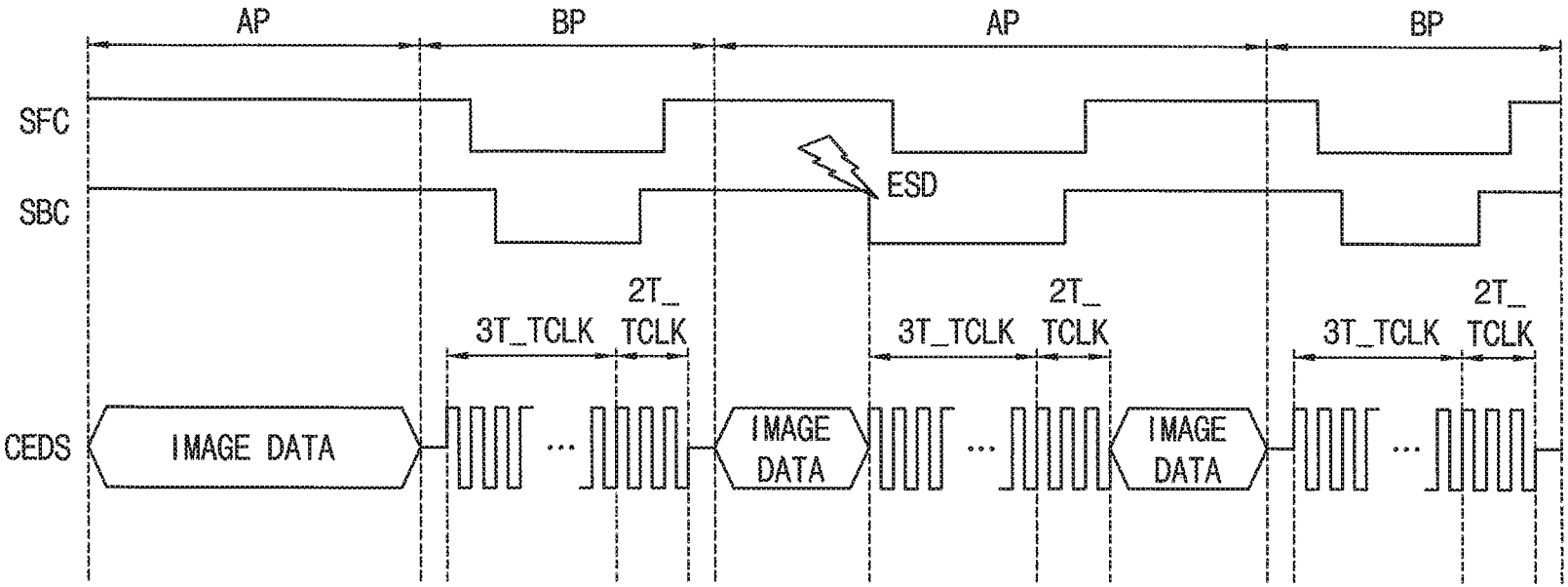
FIG. 6 is a timing diagram for describing an example of an operation of a display device according to embodiments.
Figure 7:
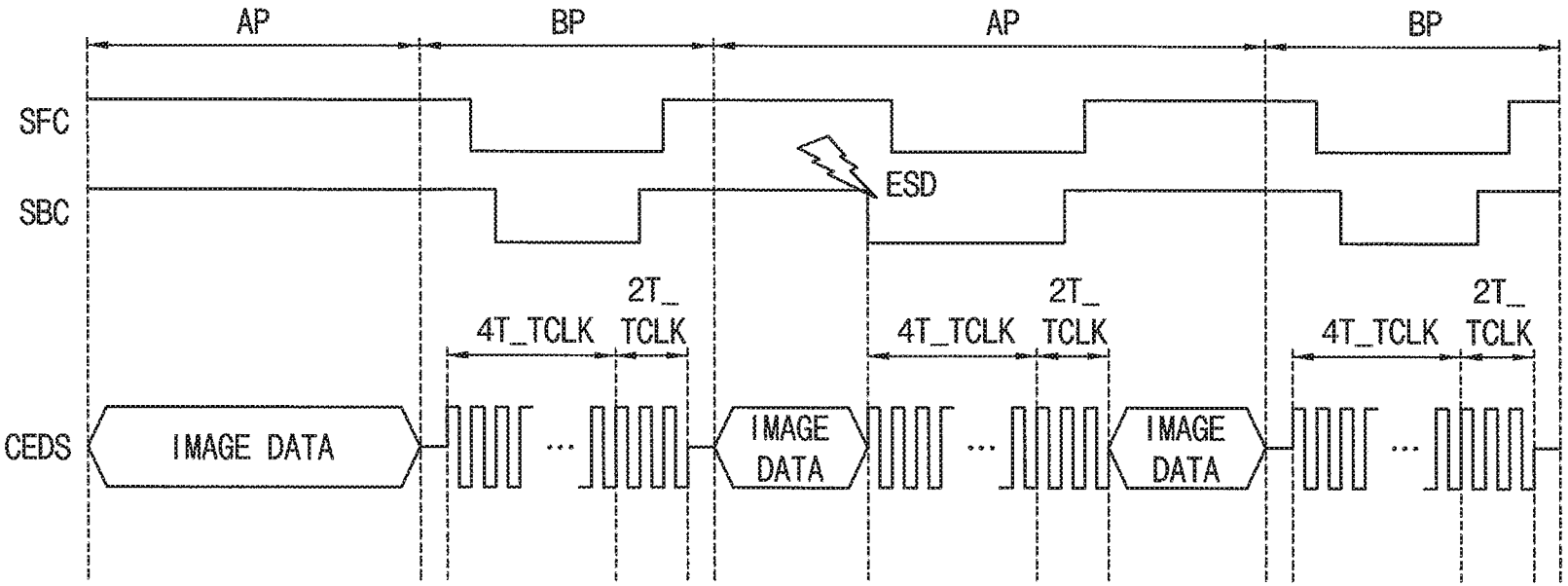
FIG. 7 is a timing diagram for describing an example of an operation of a display device according to embodiments.

FIG. 5 is a flow chart illustrating a method of operating a display device according to embodiments. FIG. 6 is a timing diagram for describing an example of an operation of a display device according to embodiments. FIG. 7 is a timing diagram for describing an example of an operation of a display device according to embodiments.

Referring to FIGS. 1 through 7, in a method of operating a display device 100, a controller 160 may transfer a clock-embedded data signal CEDS including image data IDAT to a data driver 130 in an active period AP (S310). When/if an internal clock signal ICLK of the data driver 130 is in a lock state (S320: NO), the data driver 130 may recover the image data IDAT from the clock-embedded data signal CEDS based on the internal clock signal ICLK to provide data voltages DV corresponding to the recovered image data RDAT to a plurality of pixels PX in the active period (AP) (S330).

In a blank period BP, the controller 160 may transfer the clock-embedded data signal CEDS including a training pattern to the data driver 130, and the data driver 130 may perform a training operation for the internal clock signal ICLK using the training pattern included in the clock-embedded data signal CEDS (S340, S345, S350, and S355). The training pattern in the blank period BP may include a first training clock signal modulated with a first modulation period during a first time, and may include a second training clock signal modulated with a second modulation period different from the first modulation period after the first time.

referring to FIG. 6, in the blank period BP, the controller 160 may transfer, as the first training clock signal modulated with the first modulation period, a training clock signal 3T_TCLK modulated with a modulation period corresponding to three clock periods 3T to the data driver 130 during the first time (e.g., about 4500 T) (S340). The controller 160 may inform the data driver 130 of transferring the training clock signal 3T_TCLK modulated with the modulation period corresponding to the three clock periods 3T by changing a shared forward channel SFC to a low level. In response to the training clock signal 3T_TCLK modulated with the modulation period corresponding to the three clock periods 3T, the data driver 130 may determine that the internal clock signal ICLK is in an unlock state, may inform the controller 160 of the unlock state of the internal clock signal ICLK by changing a shared back channel SBC to a low level, and may perform the training operation for the internal clock signal ICLK (S345). After the first time, the controller 160 may transfer, as the second training clock signal modulated with the second modulation period, a training clock signal 2T_TCLK modulated with a modulation period corresponding to two clock periods 2T to the data driver 130 (S350). In response to the training clock signal 2T_TCLK modulated with the modulation period corresponding to the two clock periods 2T, the data driver 130 may determine that the internal clock signal ICLK is in the lock state, and may inform the controller 160 of the lock state of the internal clock signal ICLK by changing the shared back channel SBC to a high level (S355). In response to the lock state of the internal clock signal ICLK received through the shared back channel SBC, the controller 160 may change the shared forward channel SFC to a high level, and may stop transferring the training pattern.

Referring to FIG. 7, in the blank period BP, the controller 160 may transfer, as the first training clock signal modulated with the first modulation period, a training clock signal 4T_TCLK modulated with a modulation period corresponding to four clock periods 4T to the data driver 130 during the first time (e.g., about 4500 T) (S340). The controller 160 may inform the data driver 130 of transferring the training clock signal 4T_TCLK modulated with the modulation period corresponding to the four clock periods 4T by changing the shared forward channel SFC to the low level. In response to the training clock signal 4T_TCLK modulated with the modulation period corresponding to the four clock periods 4T, the data driver 130 may determine that the internal clock signal ICLK is in the unlock state, may inform the controller 160 of the unlock state of the internal clock signal ICLK by changing the shared back channel SBC to the low level, and may perform the training operation for the internal clock signal ICLK (S345). After the first time, the controller 160 may transfer, as the second training clock signal modulated with the second modulation period, the training clock signal 2T_TCLK modulated with the modulation period corresponding to the two clock periods 2T to the data driver 130 (S350). In response to the training clock signal 2T_TCLK modulated with the modulation period corresponding to the two clock periods 2T, the data driver 130 may determine that the internal clock signal ICLK is in the lock state, and may inform the controller 160 of the lock state of the internal clock signal ICLK by changing the shared back channel SBC to the high level (S355). In response to the lock state of the internal clock signal ICLK received through the shared back channel SBC, the controller 160 may change the shared forward channel SFC to the high level, and may stop transferring the training pattern.

The data driver 130 may detect the unlock state of the internal clock signal ICLK in each clock period T of the internal clock signal ICLK not only in the blank period BP but also in the active period AP. When/if the internal clock signal ICLK is determined to be in the unlock state in the active period AP (S320: YES), the data driver 130 may inform the controller 160 of the unlock state of the internal clock signal ICLK through the shared back channel SBC (S360). In response to the unlock state of the internal clock signal ICLK received in the active period AP, the controller 160 may stop transferring the clock-embedded data signal CEDS including the image data IDAT (S365), and may transfer the clock-embedded data signal CEDS including the training pattern to the data driver 130 in the active period AP (S340 through S355).

Referring to FIG. 6, when/if an electrostatic discharge ESD occurs in the data driver 130, the data driver 130 may inform the controller 160 of the unlock state of the internal clock signal ICLK by changing the shared back channel SBC to the low level. In response to the low level of the shared back channel SBC, the controller 160 may stop transferring the clock-embedded data signal CEDS including the image data IDAT (S365), and may transfer the training clock signal 3T_TCLK modulated with the modulation period corresponding to the three clock periods 3T to the data driver 130 during the first time (e.g., about 4500 T) (S340). The controller 160 may inform the data driver 130 of transferring the training clock signal 3T_TCLK modulated with the modulation period corresponding to the three clock periods 3T by changing the shared forward channel SFC to the low level. The data driver 130 may perform the training operation for the internal clock signal ICLK based on the training clock signal 3T_TCLK modulated with the modulation period corresponding to the three clock periods 3T (S345). The controller 160 may transfer the training clock signal 2T_TCLK modulated with the modulation period corresponding to the two clock periods 2T to the data driver 130 after the first time (S350). The data driver 130 may inform the controller 160 of the lock state of the internal clock signal ICLK by changing the shared back channel SBC to the high level in response to the training clock signal 2T_TCLK modulated with the modulation period corresponding to the two clock periods 2T (S355). In response to the lock state of the internal clock signal ICLK received through the shared back channel SBC, the controller 160 may change the shared forward channel SFC to the high level, and may stop transferring the training pattern.

Referring to FIG. 7, when/if the electrostatic discharge ESD occurs in the data driver 130, the controller 160 may stop transferring the clock-embedded data signal CEDS including the image data IDAT (S365), and may transfer the training clock signal 4T_TCLK modulated with the modulation period corresponding to the four clock periods 4T to the data driver 130 during the first time (e.g., about 4500 T) (S340). The data driver 130 may perform the training operation for the internal clock signal ICLK based on the training clock signal 4T_TCLK modulated with the modulation period corresponding to the four clock periods 4T (S345). The controller 160 may transfer the training clock signal 2T_TCLK modulated with the modulation period corresponding to the two clock periods 2T to the data driver 130 after the first time (S350). The data driver 130 may inform the controller 160 of the lock state of the internal clock signal ICLK through the shared back channel SBC in response to the training clock signal 2T_TCLK modulated with the modulation period corresponding to the two clock periods 2T (S355).

In a method of operating the display device 100, as the training pattern, the controller 160 may transfer the first training clock signal modulated with the first modulation period (e.g., the training clock signal 3T_TCLK or the training clock signal 4T_TCLK) during the first time, and may transfer the second training clock signal modulated with the second modulation period different from the first modulation period (e.g., the training clock signal 2T_TCLK) after the first time. Accordingly, even if a frame frequency of the display device 100 is changed, a lock sensing error of the data driver 130 may be prevented, and an operation error of the data driver 130 may be prevented.

Figure 8:
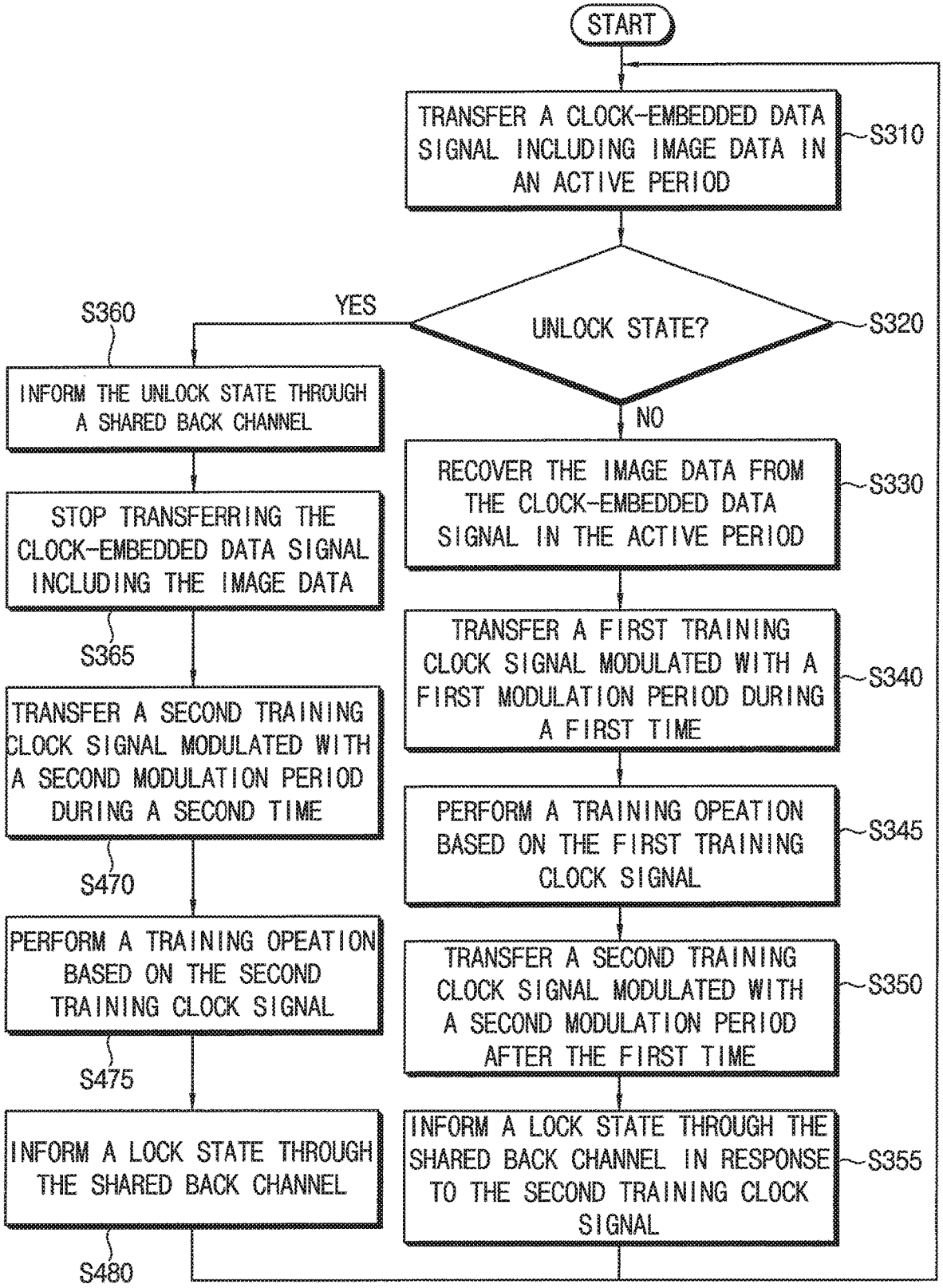
FIG. 8 is a flow chart illustrating a method of operating a display device according to embodiments.
Figure 9:
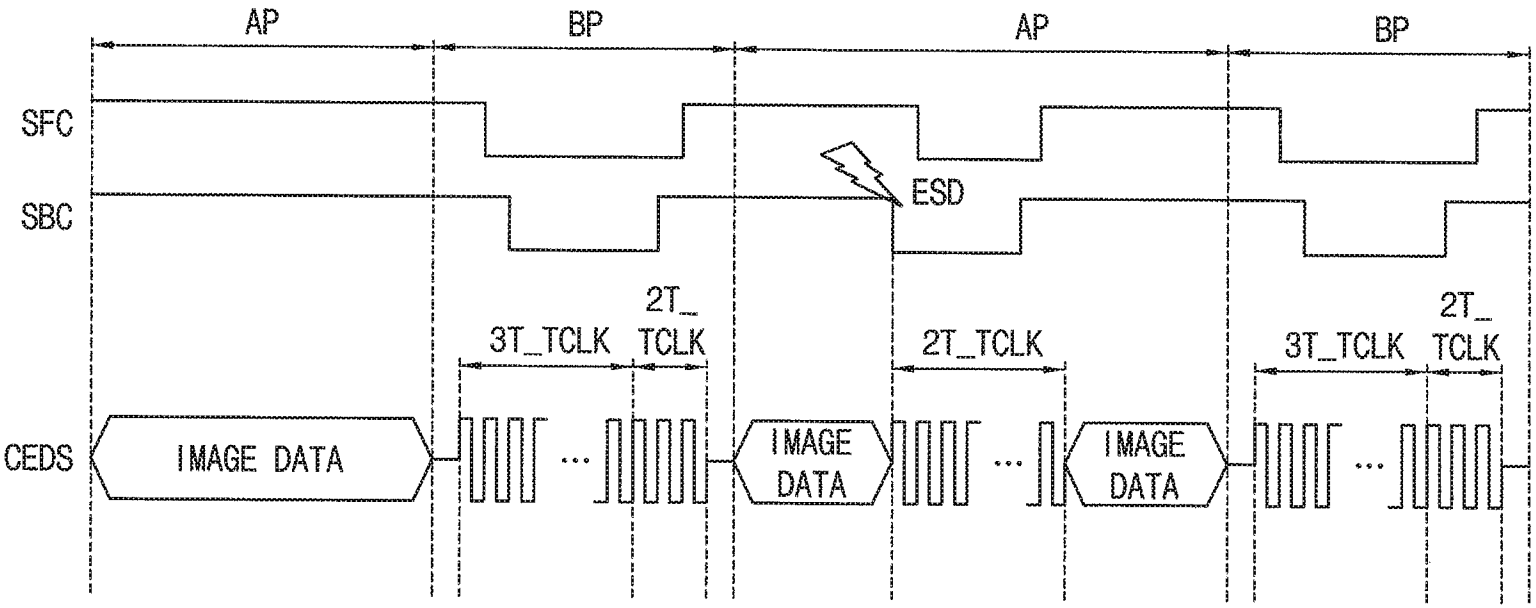
FIG. 9 is a timing diagram for describing an example of an operation of a display device according to embodiments.
Figure 10:
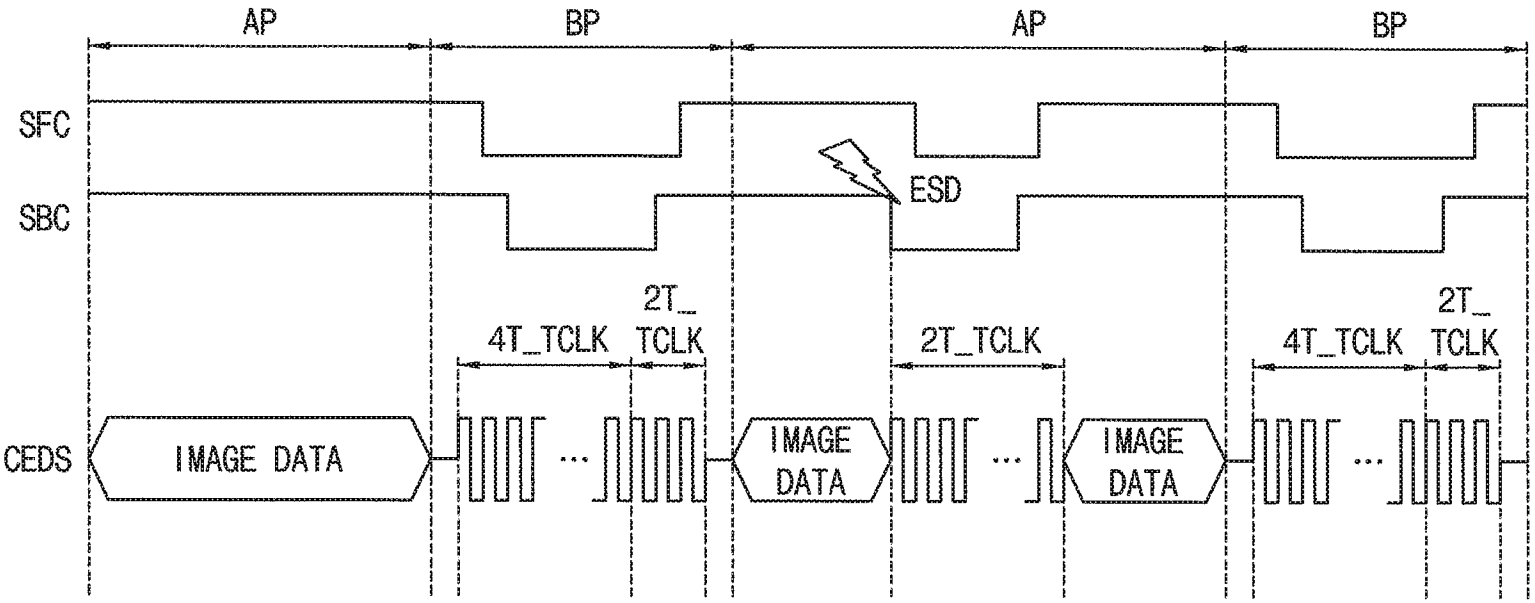
FIG. 10 is a timing diagram for describing an example of an operation of a display device according to embodiments.

FIG. 8 is a flow chart illustrating a method of operating a display device according to embodiments. FIG. 9 is a timing diagram for describing an example of an operation of a display device according to embodiments. FIG. 10 is a timing diagram for describing an example of an operation of a display device according to embodiments.

A method of operating a display device 100 illustrated in FIG. 8 may be substantially the same as a method of operating the display device 100 illustrated in FIG. 5, except that a training pattern in an active period AP is different from a training pattern in a blank period B P.

Referring to FIGS. 1 through 3 and 8 through 10, in the method of operating the display device 100, a data driver 130 may detect an unlock state of an internal clock signal ICLK in each clock period T of the internal clock signal ICLK not only in the blank period BP but also in the active period AP. When/if the internal clock signal ICLK is determined to be in the unlock state in the active period AP (S320: YES), the data driver 130 may inform a controller 160 of the unlock state of the internal clock signal ICLK through a shared back channel SBC (S360). In response to the unlock state of the internal clock signal ICLK received in the active period AP, the controller 160 may stop transferring a clock-embedded data signal CEDS including image data IDAT (S365), and may transfer the clock-embedded data signal CEDS including the training pattern to the data driver 130 in the active period AP (S470, S475, and S480). Since the internal clock signal ICLK is already determined to be in the unlock state, a lock sensing error (where the internal clock signal ICLK in the unlock state is erroneously determined to be in a lock state) may not occur. Unlike the training pattern in the blank period BP, the training pattern in the active period AP may include only a second training clock signal modulated with a second modulation period, for example, a training clock signal 2T_TCLK modulated with a modulation period corresponding to two clock periods 2T. The controller 160 may transfer the training clock signal 2T_TCLK modulated with the modulation period corresponding to the two clock periods 2T to the data driver 130 during a second time (S470). The data driver 130 may perform a training operation for the internal clock signal ICLK based on the training clock signal 2T_TCLK modulated with the modulation period corresponding to the two clock periods 2T (S475), and may inform the controller 160 of the lock state of the internal clock signal ICLK through the shared back channel SBC if the internal clock signal ICLK is locked by the training operation (S480). The length of the second time may be about 2000 T.

Referring to FIG. 9, as the training pattern in the blank period BP, the controller 160 may transfer a training clock signal 3T_TCLK modulated with a modulation period corresponding to three clock periods 3T to the data driver 130 during a first time (e.g., about 4500 T) (S340), and may transfer the training clock signal 2T_TCLK modulated with the modulation period corresponding to the two clock periods 2T to the data driver 130 after the first time (S350). As the training pattern in the active period AP, the controller 160 may transfer the training clock signal 2T_TCLK modulated with the modulation period corresponding to the two clock periods 2T to the data driver 130 during the second time (e.g., about 2000 T) (S470).

Referring to FIG. 10, as the training pattern in the blank period BP, the controller 160 may transfer a training clock signal 4T_TCLK modulated with a modulation period corresponding to four clock periods 4T to the data driver 130 during the first time (S340), and may transfer the training clock signal 2T_TCLK modulated with the modulation period corresponding to the two clock periods 2T to the data driver 130 after the first time (S350). As the training pattern in the active period AP, the controller 160 may transfer the training clock signal 2T_TCLK modulated with the modulation period corresponding to the two clock periods 2T to the data driver 130 during the second time (S470).

Figure 11:
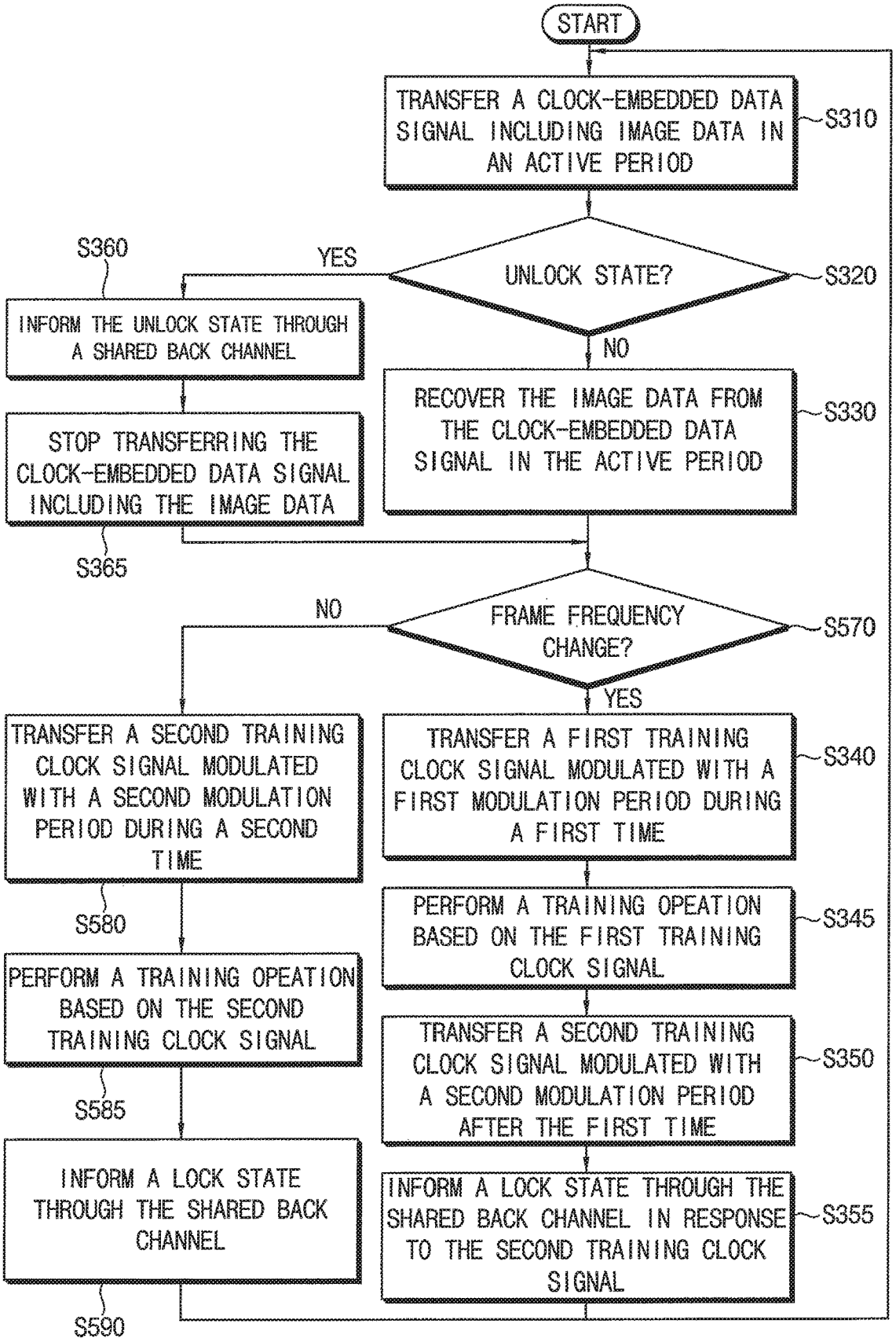
FIG. 11 is a flow chart illustrating a method of operating a display device according to embodiments.
Figure 12:
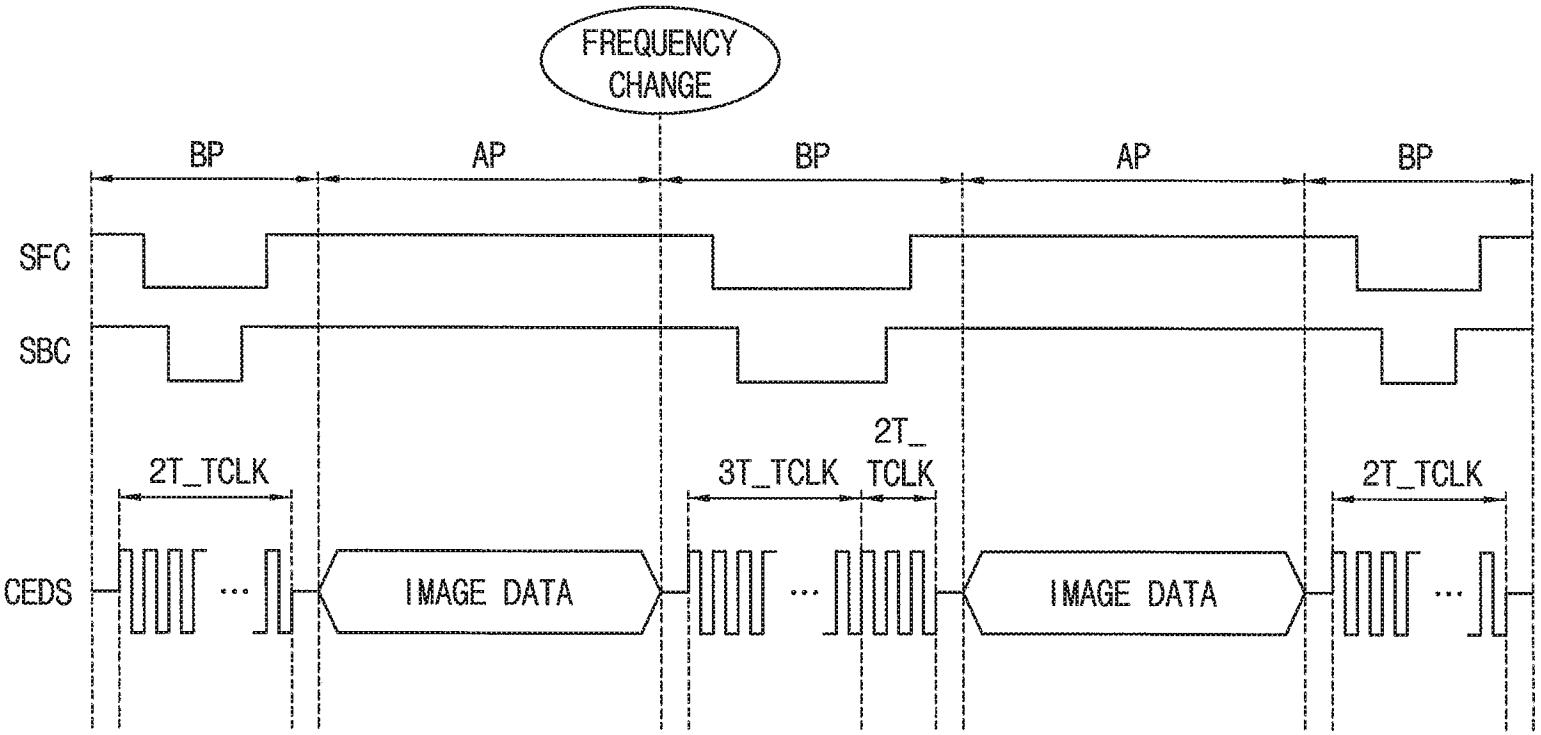
FIG. 12 is a timing diagram for describing an example of an operation of a display device according to embodiments.
Figure 13:
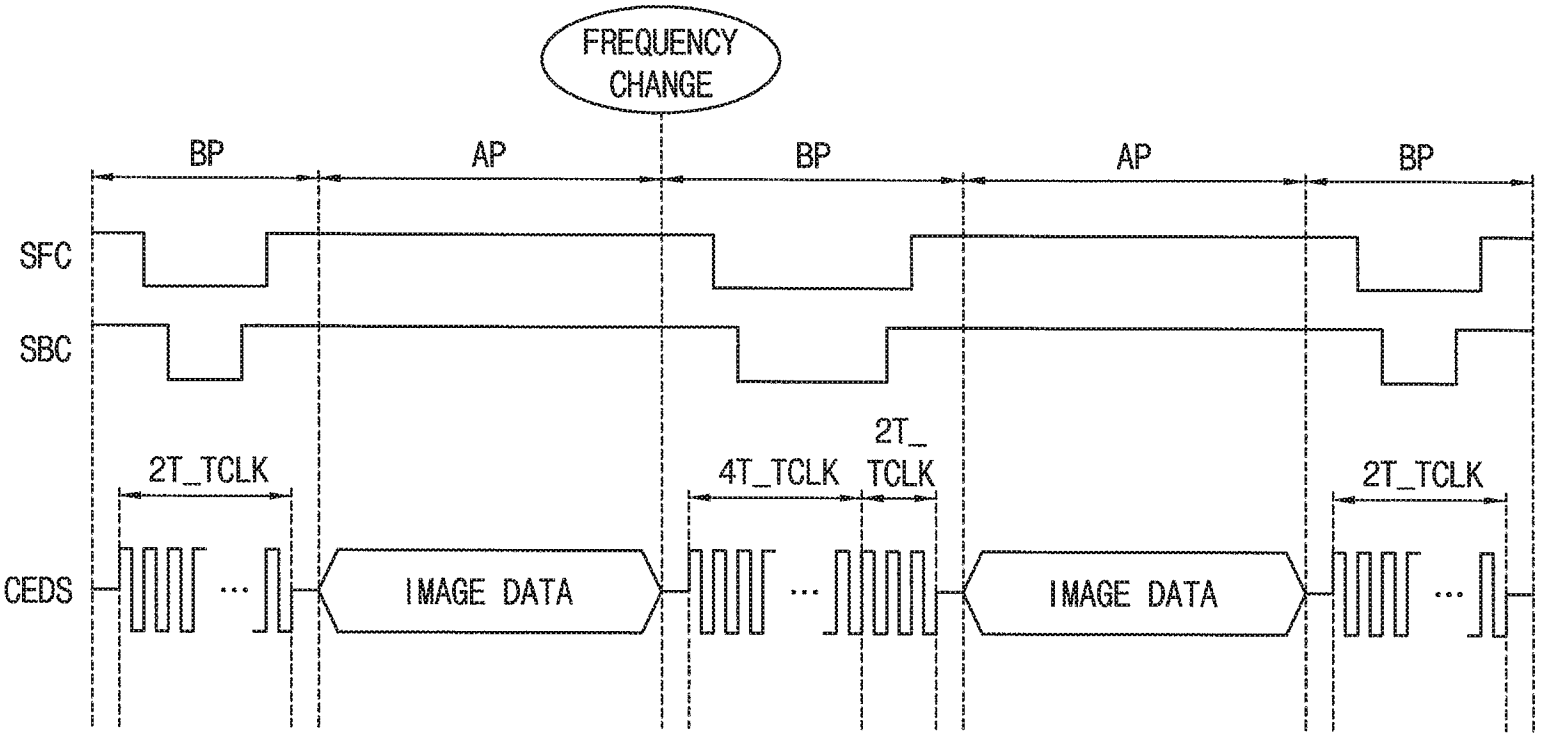
FIG. 13 is a timing diagram for describing an example of an operation of a display device according to embodiments.

FIG. 11 is a flow chart illustrating a method of operating a display device according to embodiments. FIG. 12 is a timing diagram for describing an example of an operation of a display device according to embodiments. FIG. 13 is a timing diagram for describing an example of an operation of a display device according to embodiments.

A method of operating a display device 100 illustrated in FIG. 11 may be substantially the same as a method of operating the display device 100 illustrated in FIG. 5 or FIG. 8, except that different training patterns are used according to whether a frame frequency of the display device 100 is changed or not.

Referring to FIGS. 1 through 3 and 11 through 13, in the method of operating the display device 100, a controller 160 may detect a change of the frame frequency of the display device 100 (S570). The controller 160 may detect the change of the frame frequency by detecting a change of an input frame frequency IFF of image data IDAT.

When/if the frame frequency is changed (S570: YES), the controller 160 may transfer a first training clock signal modulated with a first modulation period during a first time (S340), and a data driver 130 may perform a training operation for an internal clock signal ICLK based on the first training clock signal modulated with the first modulation period (S345). The controller 160 may transfer a second training clock signal modulated with a second modulation period after the first time (S350), and the data driver 130 may inform the controller 160 of a lock state of the internal clock signal ICLK through a shared back channel SBC in response to the second training clock signal modulated with the second modulation period (S355).

When/if the frame frequency is not changed (S570: NO), the controller 160 may transfer the second training clock signal modulated with the second modulation period to the data driver 130 during a second time (S580). The data driver 130 may perform the training operation for the internal clock signal ICLK based on the second training clock signal modulated with the second modulation period (S585), and may inform the controller 160 of the lock state of the internal clock signal ICLK through the shared back channel SBC if the internal clock signal ICLK is locked by the training operation (S590).

Referring to FIG. 12, if the frame frequency is not changed, as a training pattern in a blank period BP or an active period AP, the controller 160 may transfer a training clock signal 2T_TCLK modulated with a modulation period corresponding to two clock periods 2T to the data driver 130 during the second time (e.g., about 2000 T). If the frame frequency is changed, as the training pattern in the blank period BP or the active period AP of a frame period in which the frame frequency is changed, the controller 160 may transfer a training clock signal 3T_TCLK modulated with a modulation period corresponding to three clock periods 3T to the data driver 130 during the first time (e.g., about 4500 T), and may transfer the training clock signal 2T_TCLK modulated with the modulation period corresponding to the two clock periods 2T to the data driver 130 after the first time.

Referring to FIG. 13, when/if the frame frequency is not changed, as the training pattern in the blank period BP or the active period AP, the controller 160 may transfer the training clock signal 2T_TCLK modulated with the modulation period corresponding to the two clock periods 2T to the data driver 130 during the second time (e.g., about 2000 T). When/if the frame frequency is changed, as the training pattern in the blank period BP or the active period AP of the frame period in which the frame frequency is changed, the controller 160 may transfer a training clock signal 4T_TCLK modulated with a modulation period corresponding to four clock periods 4T to the data driver 130 during the first time (e.g., about 4500 T), and may transfer the training clock signal 2T_TCLK modulated with the modulation period corresponding to the two clock periods 2T to the data driver 130 after the first time.

Figure 14:
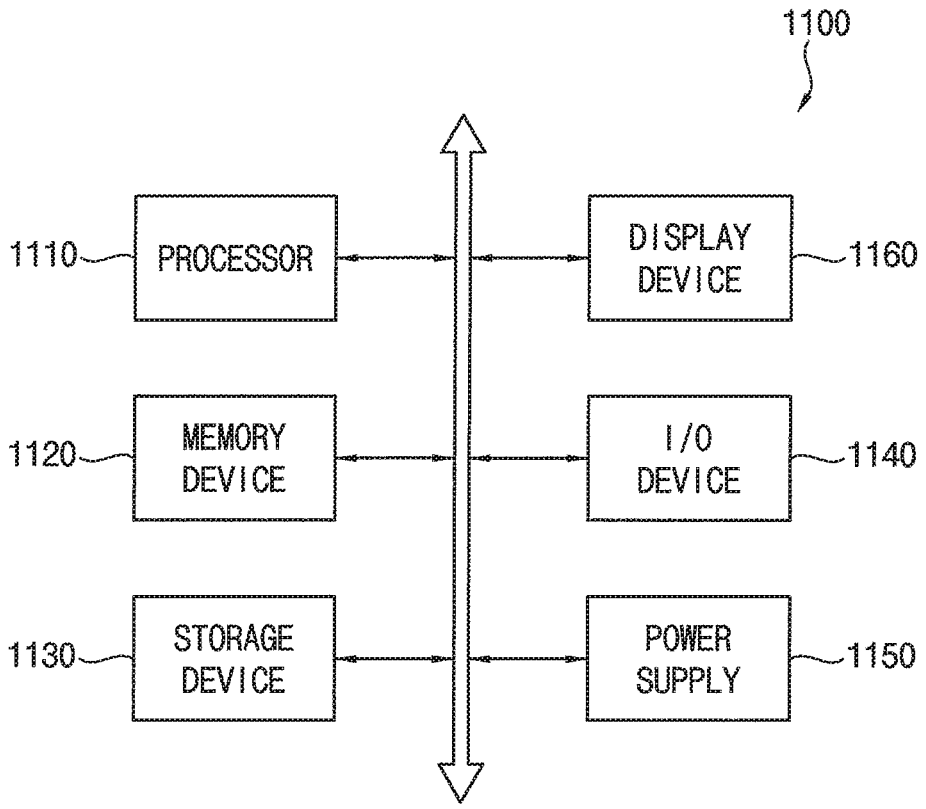
FIG. 14 is a block diagram illustrating an electronic device including a display device according to embodiments.

FIG. 14 is a block diagram illustrating an electronic device including a display device according to embodiments.

Referring to FIG. 14, an electronic device 1100 may include a processor 1110, a memory device 1120, a storage device 1130, an input/output (I/O) device 1140, a power supply 1150, and a display device 1160 electrically connected to each other. The electronic device 1100 may further include ports for communicating with at least one of a video card, a sound card, a memory card, a universal serial bus (USB) device, other electric devices, etc.

The processor 1110 may perform various computing functions or tasks. The processor 1110 may be/include at least one of an application processor (AP), a microprocessor, a central processing unit (CPU), etc. The processor 1110 may be coupled to other components via an address bus, a control bus, a data bus, etc. The processor 1110 may be further coupled to an extended bus such as a peripheral component interconnection (PCI) bus.

The memory device 1120 may store data for operations of the electronic device 1100. The memory device 1120 may include at least one non-volatile memory device such as at least one of an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be/include at least one of a solid state drive (SSD) device, a hard disk drive (HDD) device, a CD-ROM device, etc. The I/O device 1140 may be/include an input device such as at least one of a keyboard, a keypad, a mouse, a touch screen, etc., and/or an output device such as at least one of a printer, a speaker, etc. The power supply 1150 may supply power for operations of the electronic device 1100. The display device 1160 may be coupled to other components through the buses and/or other communication links.

In the display device 1160, a training pattern transferred from a controller to a data driver may include a first training clock signal modulated with a first modulation period during a first time, and a second training clock signal modulated with a second modulation period different from the first modulation period after the first time. Accordingly, even if a frame frequency of the display device 1160 is changed, a lock sensing error of the data driver may be prevented, and an operation error of the data driver may be prevented.

Embodiments may be applied an electronic device 1100 including the display device 1160. Embodiments may be applied to at least one of a television (TV), a digital TV, a 3D TV, a mobile phone, a smart phone, a tablet computer, a virtual reality (VR) device, a wearable electronic device, a personal computer (PC), a home appliance, a laptop computer, a personal digital assistant (PDA), a portable multimedia player (PMP), a digital camera, a music player, a portable game console, a navigation device, etc.

Although example embodiments have been described, many modifications are possible in the example embodiments. Accordingly, all such modifications are intended to be included within the scope of the claims.

What is claimed is:

1. A display device comprising:

a display panel including a plurality of pixels;

a controller configured to provide a clock-embedded data signal, the clock-embedded data signal including image data in an active period and including a training pattern in a blank period;

a data driver configured to receive the clock-embedded data signal, to recover the image data based on an internal clock signal in the active period, to provide data voltages corresponding to the image data to the plurality of pixels in the active period, and to perform a training operation for the internal clock signal using the training pattern, wherein the training pattern in the blank period includes a first training clock signal modulated with a first modulation period during a first time, and includes a second training clock signal modulated with a second modulation period different from the first modulation period after the first time such that the first and second training clock signals having the different first and second modulation periods are sequentially transferred within the same blank period, wherein the first training clock signal is modulated with the first modulation period corresponding to three times of a clock period of the internal clock signal such that the first training clock signal periodically has a high period of about four unit intervals, a low period of about five unit intervals, a high period of about seven unit intervals, a low period of about five unit intervals, a high period of about four unit intervals and a low period of about five unit intervals, and wherein the second training clock signal is modulated with the second modulation period corresponding to two times of the clock period of the internal clock signal such that the second training clock signal periodically has a high period of about six unit intervals, a low period of about four unit intervals, a high period of about four unit intervals and a low period of about six unit intervals.

2. The display device of claim 1, further comprising: a shared back channel electrically connected between the controller and the data driver, wherein the data driver includes:

a clock data recovery circuit configured to recover the image data, to perform the training operation that trains the internal clock signal based on the first training clock signal modulated with the first modulation period, and to inform the controller of the lock state of the internal clock signal through the shared back channel in response to the second training clock signal modulated with the second modulation period; and a data converting circuit configured to convert the image data into the data voltages in the active period, and to provide the data voltages to the plurality of pixels in the active period.

3. The display device of claim 2, wherein the clock data recovery circuit includes:

a data recovery circuit configured to recover the image data from the clock-embedded data signal in response to the internal clock signal in the active period;

a clock recovery circuit electrically connected to the data recovery circuit, configured to generate the internal clock signal, and configured to perform the training operation for the internal clock signal in response to a training enable signal; and a lock sensing circuit electrically connected to at least one of the data recovery circuit and the clock recovery circuit, configured to detect whether the internal clock signal is in the lock state or in an unlock state by determining whether the clock-embedded data signal has an edge in each clock period of the internal clock signal, and configured to provide the training enable signal to the clock recovery circuit when the internal clock signal is in the unlock state.

4. The display device of claim 3, wherein, in response to the first training clock signal modulated with the first modulation period, the lock sensing circuit provides the training enable signal to the clock recovery circuit, and informs the controller of the unlock state of the internal clock signal through the shared back channel, and wherein, in response to the second training clock signal modulated with the second modulation period, the lock sensing circuit informs the controller of the lock state of the internal clock signal through the shared back channel.

5. The display device of claim 1, wherein the first time is a clock phase locking time defined in a standard of an interface between the controller and the data driver.

6. The display device of claim 1, wherein the first modulation period corresponds to three times of the clock period of the internal clock signal, the internal clock signal being in an unlock state, and wherein the second modulation period corresponds to two times of the clock period of the internal clock signal, the internal clock signal being in a lock state.

7. The display device of claim 1, further comprising: a shared back channel electrically connected between the data driver and the controller, wherein the data driver detects an unlock state of the internal clock signal, and informs the controller of the unlock state of the internal clock signal through the shared back channel, and wherein, in response to the unlock state of the internal clock signal received in the active period, the controller stops transferring the clock-embedded data signal including the image data, and transfers the clock-embedded data signal including the training pattern in the active period.

8. The display device of claim 7, wherein the training pattern in the active period is substantially identical to the training pattern in the blank period.

9. The display device of claim 7, wherein the training pattern in the active period is different from the training pattern in the blank period.

10. The display device of claim 9, wherein the training pattern in the active period includes only the second training clock signal modulated with the second modulation period.

11. The display device of claim 7, wherein the data driver includes a plurality of data driver integrated circuits, and wherein the plurality of data driver integrated circuits shares the shared back channel.

12. A display device comprising:

a display panel including a plurality of pixels;

a controller configured to provide a clock-embedded data signal, the clock-embedded data signal including image data in an active period and including a training pattern in a blank period; and a data driver configured to receive the clock-embedded data signal, to recover the image data based on an internal clock signal in the active period, to provide data voltages corresponding to the image data to the plurality of pixels in the active period, and to perform a training operation for the internal clock signal using the training pattern; and a shared back channel electrically connected between the controller and the data driver, wherein the controller detects whether a frame frequency is changed, and transfers the training pattern including a first training clock signal modulated with a first modulation period during a first time and including a second training clock signal modulated with a second modulation period different from shorter or longer than the first modulation period after the first time training clock signal in the blank period when or after the frame frequency is changed such that the first and second training clock signals having the different first and second modulation periods are sequentially transferred within the same blank period, wherein the first training clock signal is modulated with the first modulation period corresponding to three times of a clock period of the internal clock signal such that the first training clock signal periodically has a high period of about four unit intervals, a low period of about five unit intervals, a high period of about seven unit intervals, a low period of about five unit intervals, a high period of about four unit intervals and a low period of about five unit intervals, and wherein the second training clock signal is modulated with the second modulation period corresponding to two times of the clock period of the internal clock signal such that the second training clock signal periodically has a high period of about six unit intervals, a low period of about four unit intervals, a high period of about four unit intervals and a low period of about six unit intervals.

13. The display device of claim 12, wherein, when the frame frequency is not changed, the controller transfers the training pattern including only the second training clock signal modulated with the second modulation period in the blank period.

14. The display device of claim 12, wherein the first modulation period corresponds to three times of the clock period of the internal clock signal, the internal clock signal being in an unlock state, and wherein the second modulation period corresponds to two times of the clock period of the internal clock signal, the internal clock signal being in a lock state.

15. A method of operating a display device, the method comprising:

providing, using a controller of the display device, a clock-embedded data signal including image data to a data driver of the display device in an active period;

recovering, using the data driver, the image data based on an internal clock signal to provide data voltages corresponding to the image data to a plurality of pixels of a display panel of the display device in the active period;

providing, using the controller, the clock-embedded data signal including a training pattern to the data driver in a blank period; and performing, using the data driver, a training operation for the internal clock signal using the training pattern;

wherein the training pattern in the blank period includes a first training clock signal modulated with a first modulation period during a first time, and includes a second training clock signal modulated with a second modulation period different from the first modulation period after the first time such that the first and second training clock signals having the different first and second modulation periods are sequentially transferred within the same blank period, wherein the first training clock signal is modulated with the first modulation period corresponding to three times of a clock period of the internal clock signal such that the first training clock signal periodically has a high period of about four unit intervals, a low period of about five unit intervals, a high period of about seven unit intervals, a low period of about five unit intervals, a high period of about four unit intervals and a low period of about five unit intervals, and wherein the second training clock signal is modulated with the second modulation period corresponding to two times of the clock period of the internal clock signal such that the second training clock signal periodically has a high period of about six unit intervals, a low period of about four unit intervals, a high period of about four unit intervals and a low period of about six unit intervals.

16. The method of claim 15, further comprising:

detecting, using the data driver, an unlock state of the internal clock signal; and informing, using the data driver, the controller of the unlock state of the internal clock signal through a shared back channel.

17. The method of claim 16, further comprising:

stopping, using the controller, transferring of the clock-embedded data signal including the image data in response to the unlock state of the internal clock signal received in the active period; and transferring, using the controller, the clock-embedded data signal including the training pattern to the data driver in the active period.

* * * * *